US006010204A

United States Patent [19]

Morioka et al.

[11] Patent Number: 6,010,204

[45] **Date of Patent: *Jan. 4, 2000**

[54] RECORDING APPARATUS WITH STRUCTURE FOR LOCKING AND SUPPORTING RECORDING HEAD CARRIAGE AT HOME POSITION

[75] Inventors: Hisashi Morioka, Kawagoe; Shinji Kanemitsu; Makoto Kashimura, both of Yokohama; Makoto Takemura; Shinya Matsui, both of Tokyo; Toshiyuki Onishi; Tetsuhiro Nitta, both of Yokohama; Yasuhiro Unosawa, Tokyo; Masaru Sato; Hiroshi Yoshino, both of Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/710,493

[22] Filed: Sep. 18, 1996

Related U.S. Application Data

[63] Continuation of application No. 08/111,945, Aug. 26, 1993, abandoned.

[30] Foreign Application Priority Data

Sep. 1, 1992 [JP] Japan ..... 4-233774
Nov. 10, 1992 [JP] Japan ..... 4-324795

[51] Int. Cl.[7] ..... B41J 2/51

[52] U.S. Cl. ..... 347/37

[58] Field of Search ..... 347/22, 23, 37, 347/8, 40; 400/668, 669, 674

[56] References Cited

U.S. PATENT DOCUMENTS

| | | | |
|---|---|---|---|
| 4,176,363 | 11/1979 | Kasahara | 347/19 |
| 4,177,471 | 12/1979 | Mitchell | 347/37 |
| 4,208,139 | 6/1980 | Fujimoto et al. | 400/126 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 4,970,534 | 11/1990 | Terasawa et al. | 347/32 |

FOREIGN PATENT DOCUMENTS

| | | |
|---|---|---|
| 0442713 | 8/1991 | European Pat. Off. . |
| 0452119 | 10/1991 | European Pat. Off. . |
| 0480473 | 4/1992 | European Pat. Off. . |
| 0494693 | 7/1992 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

A recording apparatus having a carriage which scans along a guide shaft and which is provided with recording heads includes a position detector for detecting the positions of the carriage in the scanning direction; and a fixing device for engaging with the carriage to regulate the carriage in the scanning direction when it is detected by the position detector that the carriage is in a given fixing position and fixing the carriage in the given fixing position. With the structure thus arranged, this recording apparatus is capable of preventing the carriage from being bent or deformed when the ink tanks and recording heads are detachably mounted or the gap adjustment for the recording heads are executed on the carriage, thus enabling the operation and positioning of the carriage to be executed exactly.

33 Claims, 26 Drawing Sheets

RECORDING APPARATUS WITH STRUCTURE FOR LOCKING AND SUPPORTING RECORDING HEAD CARRIAGE AT HOME POSITION

This application is a continuation of application Ser. No. 08/111,945 filed Aug. 26, 1993, now abandoned.

BACKGROUND OF THE INVENTION

1. Field of the Invention

The present invention relates to a recording apparatus of such a structure that recording means is mounted on a carriage which travels along a recording medium to record images on it by use of the recording means.

2. Related Background Art

A recording apparatus having the functions of a printer, copying machine, facsimile, and the like or a recording apparatus used as an output device for a complex type electronic equipment or a work station including a computer, word processor, and others, is structured so that images are recorded on a recording material (recording medium) such as a paper sheet and a thin plastic sheet in accordance with image information. These recording apparatuses can be classified as an ink jet type, a wire dot type, a thermal type, a laser beam type, and some others according to the recording methods to be adopted.

In a serial type recording apparatus which employs a serial scan method whereby to execute its main scanning in the direction orthogonal to the feeding direction (sub-scanning direction) of a recording material, the recording material is set at a given recording position; images are recorded (main scanned) by the use of recording means mounted on a carriage which travels along the recording material; subsequent to the completion of a one-line recording, the sheet is fed by a given amount (pitch feeding); then, the next line recording (main scanning) is executed on the recording material which has come to a stop again; thus, by repeating this sequence of operations, the entire recording on the recording material will be executed. On the other hand, in a recording apparatus of a line type where the recording is executed only by the sub-scanning in the feed direction of a recording material, the recording material is set at a given recording position; subsequent to the completion of a one-line recording collectively, the sheet is fed by a given amount (pitch feeding); then, by repeating the operations of executing the next line recording collectively, the entire recording on the recording material will be executed.

Among the above-mentioned recording apparatuses, the ink jet type recording apparatus (ink jet recording apparatus) is such that ink is discharged from recording means (recording head) onto a recording material for recording. With this type, it is possible to make the recording means compact and record highly precise images at a high speed. It is also possible to record on an ordinary sheet without any particular treatments given to it, thus providing inexpensive running cost. Having no impact, this type generates less noises. Also, among other advantages, this type of recording allows many different colors of ink to be used easily for recording color images.

Particularly, for an ink jet type recording means (recording head) which utilizes thermal energy for discharging ink, the one having the arrangement of highly densified liquid passages (discharge port arrangement) can be manufactured easily by forming the filmed electrothermal transducers, electrodes, liquid passage walls, a ceiling plate, and others on a substrate through the etching, vapor deposition, sputtering, and other semiconductor fabrication processes. It is thus possible to implement the provision of a more compact recording means.

Nevertheless, in a serial type recording apparatus such as this, there are the following problems encountered by its user when he attaches or detaches a member (an ink tank, a recording head, or the like, for example) to or from the carriage or operates a member mounted on the carriage (a member needed to adjust the space between a platen and a recording head, or the like, for example):

Firstly, if the carriage is not fixed to the carriage rails, it is not easy for the user to execute the above-mentioned operations because the carriage moves when the user attempts to do such operations.

Secondly, the forces exerted by such operations and others will affect the carriage to bend the carriage or the guide rails, making it difficult to execute the operations and others exactly or to cause the distance between the recording means mounted on the carriage and the platen to be varied inevitably. Then, the recording quality may be lowered. Particularly, in an ink jet recording apparatus, the variations of the space between the recording medium placed on its platen and ink jet recording head will produce adverse effects on the recording quality.

Further, in an ink jet recording apparatus, if its ink jet recording head cannot be located exactly in a position for capping or the carriage guide rails are bent, a problem is encountered in carrying out the capping for the head appropriately.

Now, in the serial type recording apparatus, the fixing method for the carriage in the main scanning direction has hitherto been such that the carriage is fixed manually when it is not in use or the carriage is brought to a stop position by an electrical system using a stepper motor among some others.

Also, there is a recording apparatus which is provided with a manual carriage locking mechanism as another fixing method. In this recording apparatus, the scanning is executed along the carriage guiding shafts arranged in parallel with the carriage platen, and when the recording apparatus is not in use, the carriage locking button which is provided for the recording apparatus is operated manually in order to fix the carriage so that it will not move in the scanning direction with respect to the carriage guiding shafts.

However, since the above-mentioned prior arts require the manual operation to fix the carriage, there are problems inherent in the user's manual operation that he forgets it or finds it troublesome. Also, the electrical positioning will present a problem that the forces will become insufficient to fix the carriage properly if the electric supply from its source should be somehow suspended. Therefore, it is difficult to fix the carriage reliably in either case. Also, it is difficult to avoid the bending of the carriage when the above-mentioned operations are to be executed in accordance with its requirements.

SUMMARY OF THE INVENTION

It is an object of the present invention to solve the above-mentioned technical problems and provide a recording apparatus capable of presenting a good operability as well as obtaining an excellent recording quality.

It is another object of the present invention to provide a recording apparatus capable of fixing the carriage at a given fixing position reliably.

It is still another object of the present invention to provide a recording apparatus in which the carriage that scans along the guide shaft is detected by position detection means when the carriage comes to a given fixing position, thus enabling fixing means to automatically engage with the carriage, so that the carriage is regulated in the scanning direction to fix it at the aforesaid given position reliably.

It is a further object of the present invention to provide a recording apparatus capable of executing the operations and positioning of a carriage exactly by preventing the carriage from being bent when an ink tank or recording head is attached to or detached from the carriage or the operations such as the gap adjustment of the recording head and others are executed on the carriage.

It is still a further object of the present invention to provide a recording apparatus in which its carriage is fixed at a given position within the carriage traveling range by positioning and fixing means, and a supporting means which is different from the aforesaid fixing means, and it is possible to execute the operations and positioning of the carriage exactly by preventing the carriage from being bent when an ink tank or recording head is attached to or detached from the carriage or the operations such as the gap adjustment of the recording head and others are executed on the carriage.

It is another object of the present invention to provide a recording apparatus having a carriage which scans along the guide shaft and which is provided with a recording head, including the following:

position detection means for detecting the position of the aforesaid carriage in its scanning direction; and fixing means for engaging with the carriage to regulate the carriage in the scanning direction when it is detected by the aforesaid position detection means to indicate that the carriage is in a given fixing position, as well as for fixing the carriage at the aforesaid given fixing position.

BRIEF DESCRIPTION OF THE DRAWINGS

FIG. 16A is a cross-sectional view schematically showing the carriage fixing unit which uses a fixing pin. FIG. 16B is a schematic view illustrating a suction cap and recording head.

FIG. 17A is a cross-sectional view schematically showing the carriage fixing unit which uses a fixing pin. FIG. 17B is a schematic view illustrating a suction cap and recording head.

DETAILED DESCRIPTION OF PREFERRED EMBODIMENTS

Hereinafter, with reference to the accompanying drawings, the description will be made of the embodiments according to the present invention.

For the embodiments described below, a plurality of given positions for fixing a carriage are defined by fixing means.

The fixing means is so arranged that the carriage is fixed by utilizing the pressing force or the carriage is fixed by utilizing the tensioning force.

Also, the fixing means is provided with a buffering member as buffering means with respect to the load required to fix the carriage.

Further, the carriage is rotatively supported by a guide shaft. When the carriage is fixed by the aforesaid fixing means, it may be possible to provide a rotation regulating means to regulate the rotation of the carriage, or to make the rotation regulating means a part of the recovery unit which constitutes a cap, or to arrange a coupling unit of the aforesaid fixing means for engaging with the carriage, which is located between the aforesaid guide shaft and rotation regulating means.

Also, the recording heads are capable of discharging a plurality of color ink materials for recording images in color on a recording medium.

Further, after the carriage is fixed by fixing means, a cap is pressed to the recording heads to cover its discharging ports.

Then, the recording heads are arranged to utilize thermal energy for discharging ink and may be provided with the electrothermal transducers to generate the aforesaid thermal energy.

(First Embodiment)

At first, the description will be made of the entire structure of a first embodiment of the recording apparatus according to the present invention by exemplifying a recording apparatus of an ink jet type.

Figure 1:
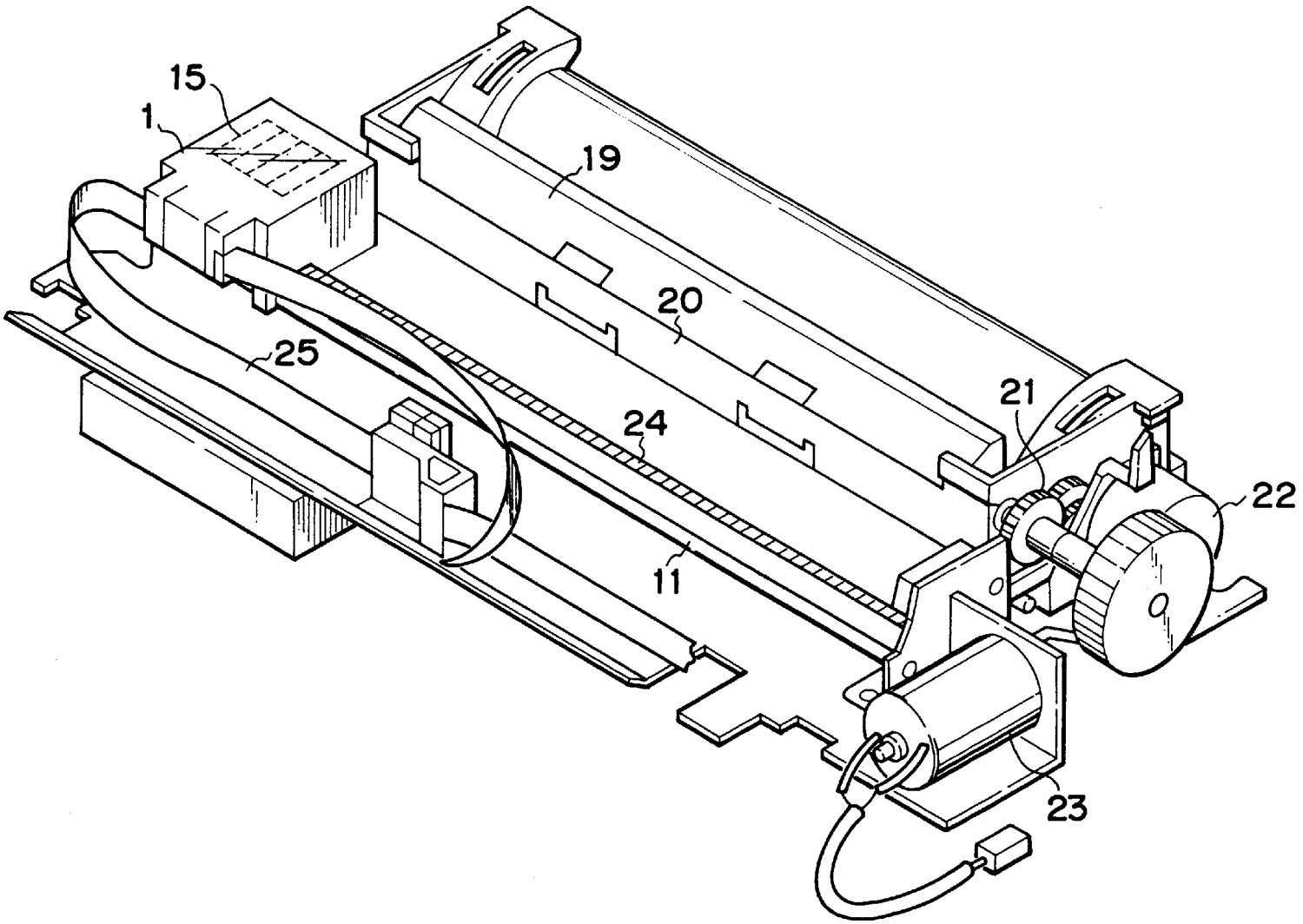
FIG. 1 is a perspective view schematically illustrating the entire structure of a recording apparatus as an embodiment according to the present invention.

As shown in FIG. 1, a plurality (four in the present embodiment) of recording heads 15 are detachably mounted on a carriage 1. This carriage 1 is driven by a carriage motor 23 through a carriage belt 24 a part of which is connected to the carriage. Along a guide shaft 11, the carriage can travel in the main scanning direction. As the carriage travels, the recording heads 15 can scan for recording. A recording medium (not shown) is fed by a feeding roller (not shown) driven by a sheet feeding motor 22 through gears 21 in the sub-scanning direction orthogonal to the aforesaid main scanning direction. This feeding roller is arranged below a platen roller 19. The recording medium being fed thereby is conveyed upward between a sheet pressing board 20 and the platen 19. During this period, the aforesaid recording medium is regulated by the sheet pressing board 20 and the platen 19, and a recording is made by ink discharged from the recording heads 15 to the recording area opposite to the recording heads 15. Then, the recording medium is exhausted to the upper part of the recording apparatus. A flexible substrate 25 transmits the printing data, driving power, and others to the recording heads 15.

Here, the details of the recording heads 15 will be described.

Figure 2:
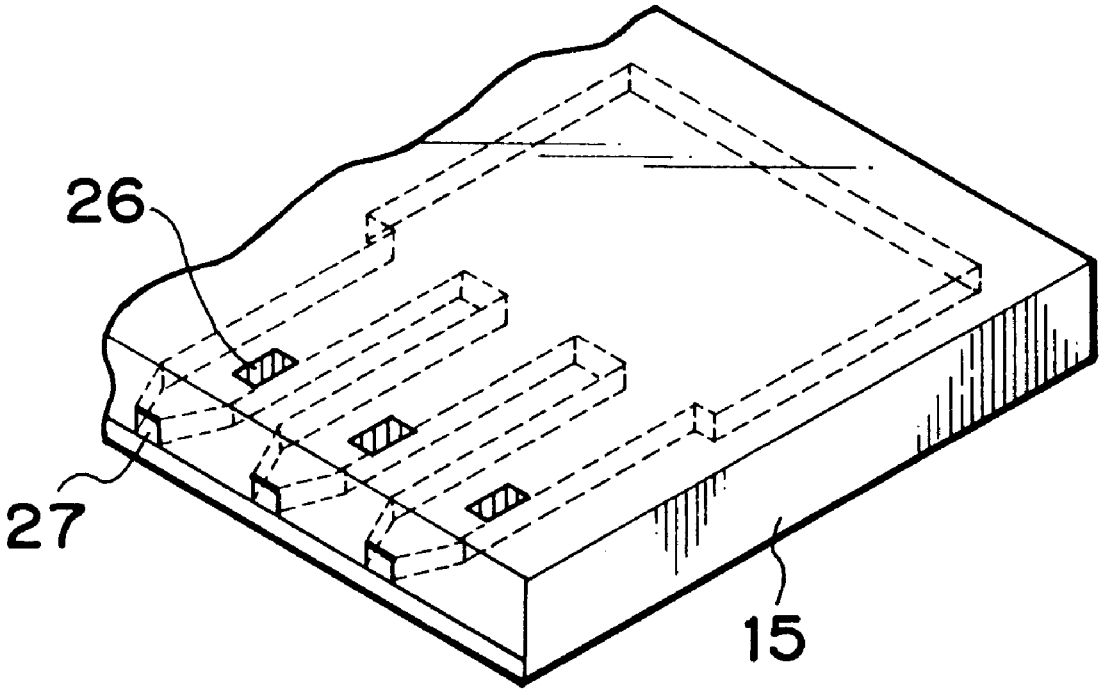
FIG. 2 is a perspective view schematically illustrating a recording head shown in FIG. 1.

As shown in FIG. 2, in order to discharge recording liquid (ink) from a plurality of discharging ports 27 arranged in a row, electrothermal transducers 26 are respectively arranged in the recording heads 15 for each of the liquid passages to generate the thermal energy to which an applied voltage is supplied. Then, when applying the driving signals, the electrothermal transducers 26 generate the thermal energy to enable the film boiling to be created for the formation of air bubbles in the respective ink liquid passages. By the development of these air bubbles, the ink droplets are discharged from the aforesaid discharging ports 27.

Now, again, as shown in FIG. 1, a plurality of capping positions are defined as given fixing positions on one end side (the left-hand side in FIG. 1) of the scanning area of the carriage 1. When the recording apparatus is not in use, any recording is suspended, or some other similar events take place, the carriage 1 is shifted to the aforesaid capping positions, and then, the cap of a recovery unit (not shown, but to be described later) advances to abut upon the front end of the recording heads 15 under pressure and airtightly close the discharging ports (not shown). In this way, it is possible to prevent the discharging ports of the recording heads 15 from being dried as well as from being adversely affected by any adhesion of dust particles or the like. At the same time, it becomes possible to execute the ink suction from the recording heads 15. Here, the scanning area of the carriage 1 means the maximum recordable width of a recording sheet inherent in a recording apparatus. Each of the above mentioned carriage 1, guide shaft 11, platen 19, and other components are housed in a chassis which serves as the main body of a recording apparatus which will be described later.

Figure 3:
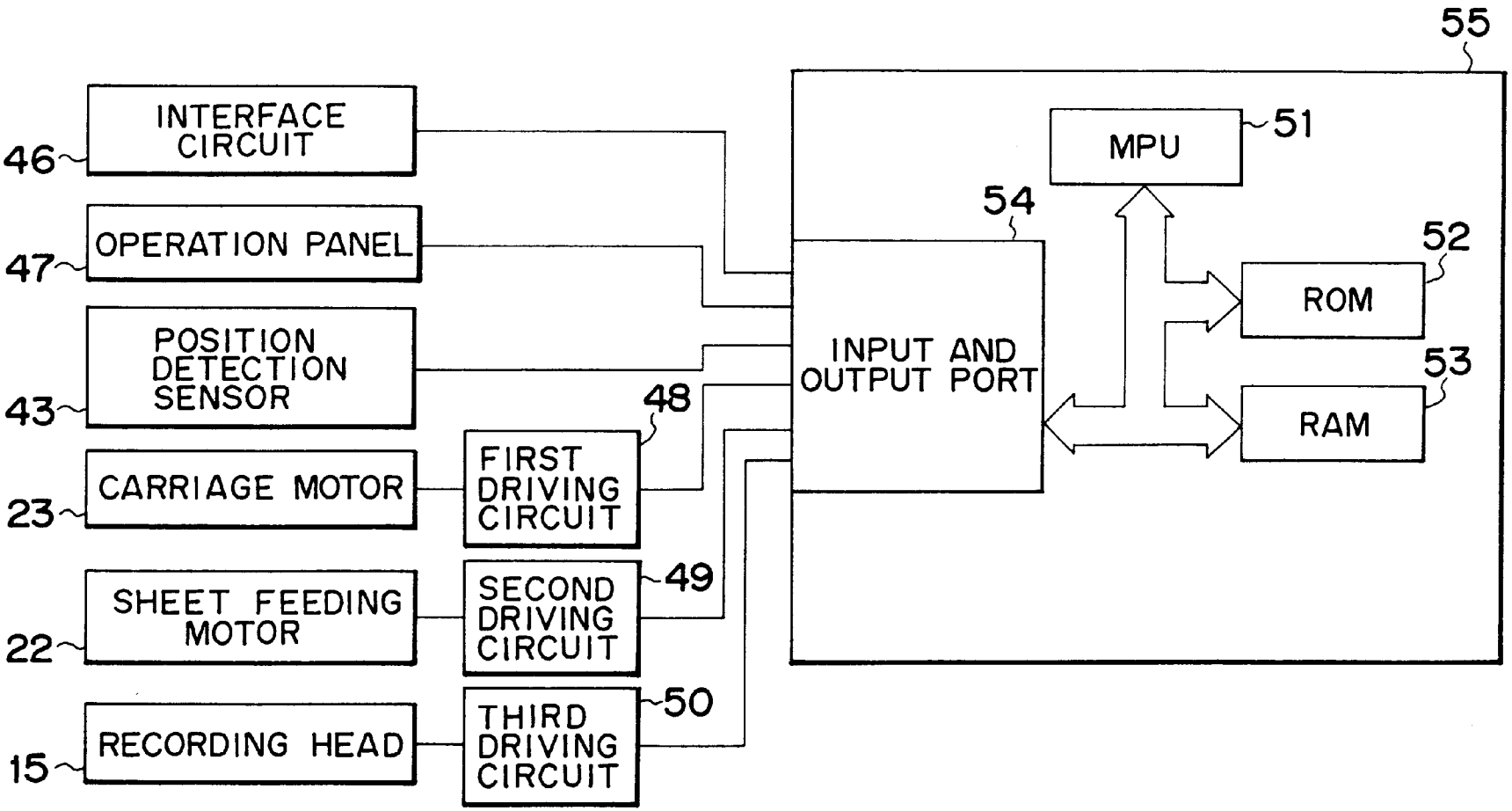
FIG. 3. is a block diagram showing the control of a recording apparatus as an embodiment according to the present invention.

As shown in FIG. 3, the recording operation of this recording apparatus is executed under the control of a control unit 55 comprising an MPU 51 which controls the entire system of the apparatus while transmitting or receiving signals between each of the units of the recording apparatus; a ROM 52 storing the sequence or the like regarding the recording operation and processing; a RAM 53 used as the buffer for the recording data as well as the work area for the processing to be executed by the MPU 51, and others; and input and output ports 54. In other words, the control signals from the control unit 55 are supplied to first, second, and third driving circuits 48, 49, and 50. The first, second, and third driving circuits 48, 49, and 50 drive the carriage motor 23, sheet feeding motor 22, and recording heads 15, respectively. Also, the control unit receives recording data from a computer serving as a host equipment through an interface circuit 46. The control operation of the recording apparatus is executed by operating the switches, keys, and the like which are provided for an operation panel 47. A position detection sensor serving as a position detection means which will be described later detects whether the carriage (not shown) is in the capping position (standby position) or not.

Figure 29:
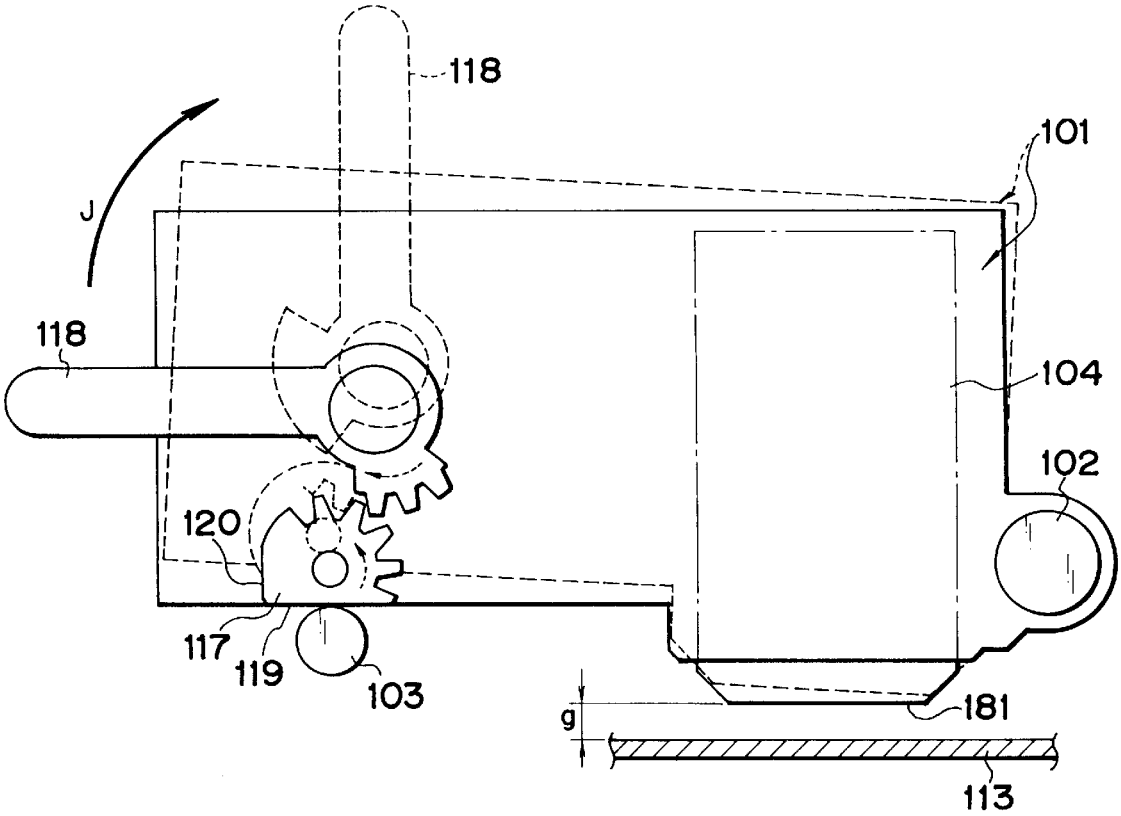
FIG. 29 is a schematic side view illustrating a mechanism for a gap adjustment between recording means and a recording medium in a recording apparatus.

Further, an ink jet recording apparatus is required as described in conjunction with FIG. 29 to carry out a control in maintaining the space (a distance to a recording sheet) between the recording heads 104 and recording material 113 correctly in order to secure a good quality of recorded images. FIG. 29 is a schematic side view showing the structure (of a gap adjusting mechanism) which uses a gap adjusting lever for the adjustment (control) of the above mentioned distance to the recording sheet. In FIG. 29, a supporting shaft abutting member 117 which abuts upon a supporting shaft 103, and a gap adjusting lever 118 which engages with the supporting shaft abutting member 117 to be able to transmit the rotational force are rotatively supported in a carriage 101, respectively. Then, on the supporting shaft abutting member 117, a plurality of abutting surfaces (in the example shown in FIG. 29, two locations) 119 and 120 are formed at heights each different from the rotational center.

In FIG. 29, when the gap adjusting lever 118 in the position indicated by a solid line is rotationally operated to the position indicated by a chain line in the direction indicated by an arrow J, the supporting shaft abutting member 117 follows rotationally, and allows the part of the supporting shaft abutting member 117 which abuts upon the supporting shaft 103 to be displaced from a lower abutting surface 119 to a higher abutting surface 120. The interval between the carriage 101 and supporting shaft 103 can be varied (increased). As a result, the carriage 101 is rotated in the lifting direction from the solid-lined position to the chain-lined position around a guide rail 102, hence raising the discharging port surface of the recording heads 104. In other words, if a thicker recording material 113 is used, the gap (distance to the recording sheet) g between the discharging port surface and the recording material 113 can be adjusted by the above-mentioned gap adjustment to a given correct value. Therefore, by operating the gap adjusting lever 118, the above-mentioned gap g can be adjusted to a correct value corresponding to the various thicknesses of the recording materials.

In this respect, the above-mentioned gap adjustment mechanism is not represented in the drawings of each embodiment set forth below.

Now, the characteristic parts of the present embodiment will be described.

Figure 4:
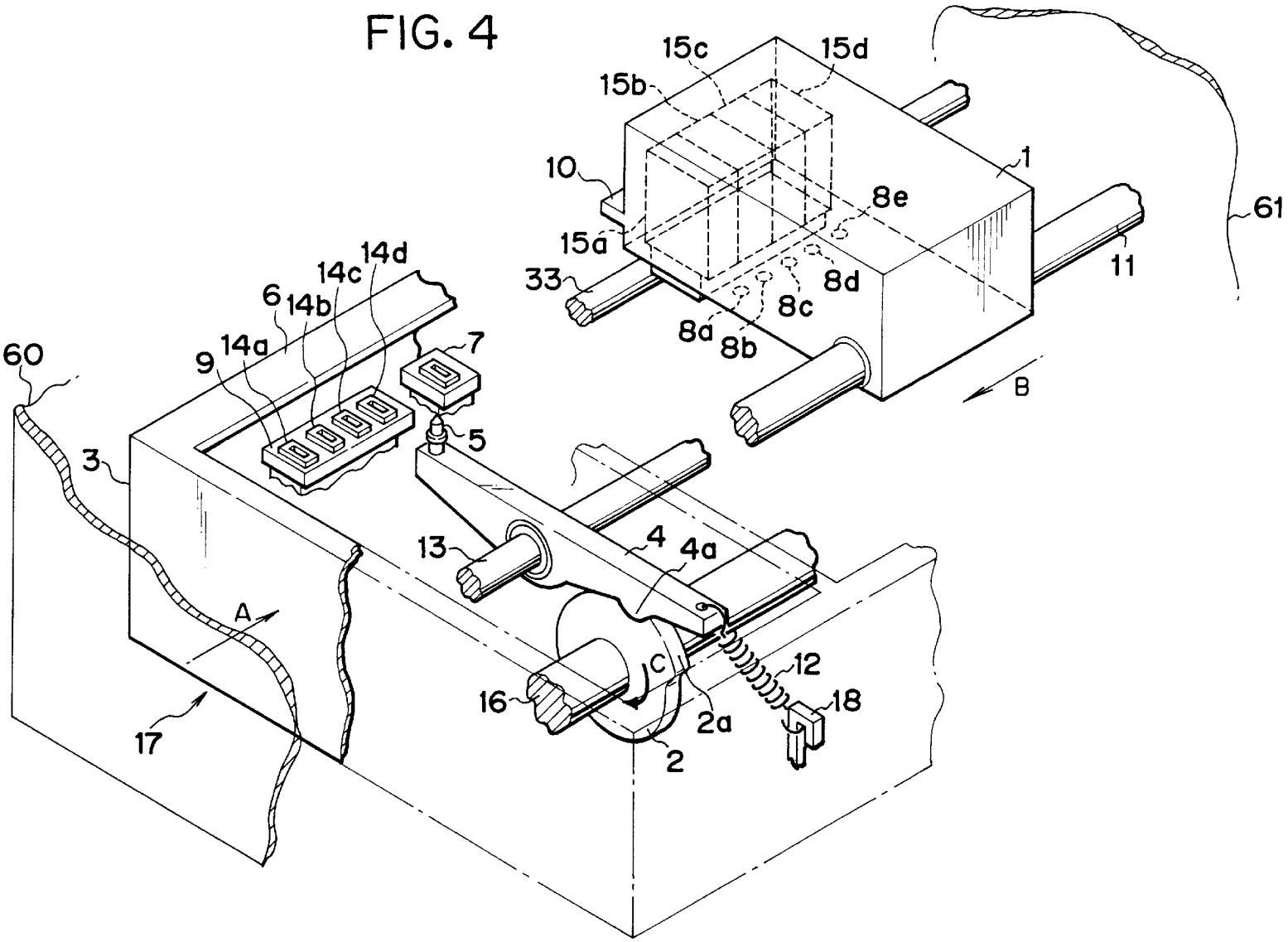
FIG. 4 is a perspective view schematically illustrating a carriage, a recovery unit, and others according to a first embodiment of the recording apparatus of the present invention.
Figure 5:
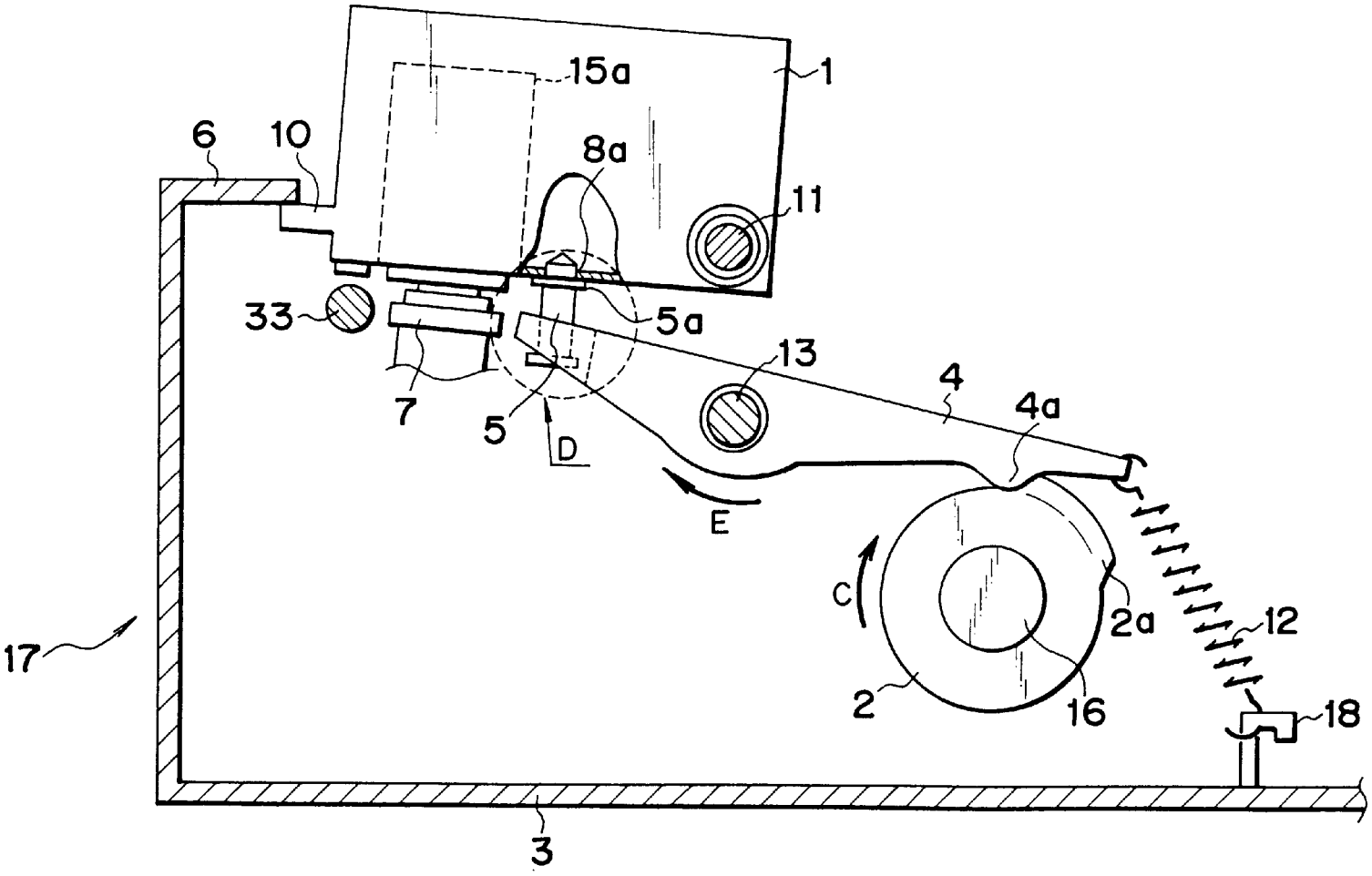
FIG. 5 is a vertical sectional view schematically showing those elements in FIG. 4 observed in the direction indicated by an arrow A.

FIG. 4 is a perspective view schematically showing the carriage and recovery unit which are characteristic parts of the present embodiment. FIG. 5 is a vertical sectional view schematically showing those elements shown in FIG. 4 observed in the direction indicated by an arrow A.

As shown in FIG. 4 and FIG. 5, to the chassis 60 and 61 of a recording apparatus, a guide shaft 11 is installed. On a carriage 1, the four recording heads 15*a*, 15*b*, 15*c*, and 15*d* are provided to discharge the ink of different colors, cyan, magenta, yellow, and black, respectively. This carriage 1 is supported movably in the directions indicated by arrows A and B along the guide shaft 11, and also rotatively supported. The front part of the carriage 1 is supported by a shaft 33 on which it is mounted. The aforesaid four recording heads 15*a*, 15*b*, 15*c*, and 15*d* are arranged in a row in the traveling direction of the carriage 1 (in the direction B indicated by an arrow B and opposite direction thereto). On the lower end of the carriage 1, circular five holes, the first, second, third, fourth, and fifth holes, 8*a*, 8*b*, 8*c*, 8*d*, and 8*e* are formed. These five holes 8*a*, 8*b*, 8*c*, 8*d*, and 8*e* are also arranged in the direction indicated by the arrow B. On the front end of the carriage 1, a stopper 10 on the carriage side is integrally extruded.

A recovery unit 17 comprises the recovery unit main body 3 serving as its exterior part the front of which functions as a stopper 6 on the recovery unit side; a protective cap 9 having the four caps 14*a*, 14*b*, 14*c*, and 14*d* arranged at equal intervals to each other; a suction cap 7 made of a resilient material such as rubber to execute the recovery operation for the recording heads 15*a*, 15*b*, 15*c*, and 15*d*; and the lever 4, cam 2, and others which function as the fixing means which will be described later. The intervals between the four holes, the first, second, third, and fourth ones, are equal to each other. These intervals are also equal to those between the four caps 14*a*, 14*b*, 14*c*, and 14*d* as well as between the recording heads 15*a*, 15*b*, 15*c*, and 15*d*. Also, the interval between the fourth hole 8*d* and the fifth hole 8*e* is equal to the one between the forth cap 14*d* and the suction cap 7. The central part of the lever 4 serving as fixing means is rotatively supported by a shaft 13 extensively installed in the recovery unit main body 13. On the one end of the lever 4 on the protective cap 9 side, a fixing pin 5 is integrally extruded having a flange 5*a* near its mid point so that the pin can be inserted into the aforesaid five holes 8*a*, 8*b*, 8*c*, 8*d*, and 8*e*. On the lower end of the other end thereof, an extrusion 4*a* is formed. The outer diameter of the fixing pin 5 is slightly smaller than that of the five holes 8*a*, 8*b*, 8*c*, 8*d*, and 8*e*, while the outer diameter of the foregoing flange 5*a* is slightly larger than the diameter of the holes 8*a*, 8*b*, 8*c*, 8*d*, and 8*e*. The stopper 10 on the carriage side and stopper 6 on the recovery unit side constitute rotation regulating means.

Also, between the other end of the lever 4 and the anchor 18 extruded from the recovery unit main body 3, a coil spring 12 is fixed to give a tensioning bias to the lever 4. A cam 2 having an extrusion 2*a* is integrally arranged on the rotational shaft 16 which is rotatively installed on the recovery unit main body 13. This cam is provided in order to drive the lever 4. This rotational shaft 16 is rotated only to a given angle by a cam driving motor 45 (refer to FIG. 6) through a transmission mechanism (not shown) comprising gears and others. As described above, the two shafts 13 and 16 are supported by the recovery unit main body 3. On the other hand, the guide shaft 11 is supported by the chassis 60 and 61. Therefore, the vibrations of the traveling carriage 1 are not transmitted to the cam 2 and lever 4.

For this recording apparatus, there are required five operations in total, that is, the recovery operations each individually required for the four recording heads 15*a* to 15*d*, and the capping operation to cover the four recording heads 15*a* to 15*d* at a time. Consequently, there exist as given fixing positions for the carriage 1 (capping positions), the first to fifth specific five fixing positions corresponding to each of the aforesaid five operations.

The first to fourth specific fixing positions are the position of the carriage 1 when the first to fourth recording heads 15*a* to 15*d* face the suction cap 7, respectively, while the fifth specific position is the position of the carriage 1 when the first to fourth recording heads 15*a* to 15*d* face the first to fourth caps 14*a* to 14*d* of the protective cap 9, respectively. These first to fifth specific fixing positions are registered in advance in the control unit 44 shown in FIG. 6.

Figure 6:
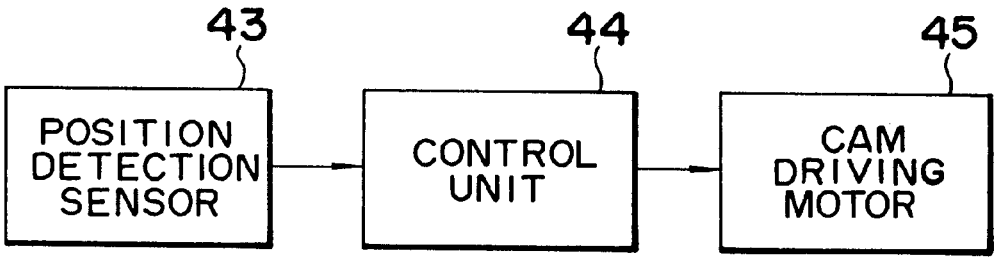
FIG. 6 is a block diagram showing the driving control of the cam illustrated in FIG. 4 and FIG. 5.

Then, as shown in FIG. 5 and FIG. 6, the position detection sensor 43 serving as position detection means detects the positions of the carriage 1 in the scanning direction. When it is detected by the position detection sensor 43 that the carriage 1 is in the first to fifth fixing positions as given, the control unit 44 controls the cam driving motor 45 to drive the rotational shaft 16 (refer to FIG. 5) to rotate in the direction indicated by an arrow C in FIG. 5

Now, the operation of the present embodiment will be described.

As shown in FIG. 4 and FIG. 5, the extrusion 4*a* of the lever 4 disengages from the extrusion 2*a* of the cam 2 in the initial state. The one end of the lever 4 on the fixing pin 5 side is in the descending position. In order to execute the recovery operation of the first recording head 15*a*, the carriage 1 is shifted in the direction indicated by the arrow B, that is, to the recovery unit 17 side. When the first recording head 15*a* is suspended at the first fixing position as given to face the suction cap 7, this event is detected by the position detection sensor 43 (refer to FIG. 6). In this way, by means of the cam driving motor 45 which is controlled by the control unit 44, the cam 2 incorporated in the recovery unit main body 3 rotates in the direction indicated by an arrow C. Thus, the extrusion 2*a* of the cam 2 disengages from the extrusion 4*a* of the lever 4. Consequently, due to the tension exerted by the coil spring 12, the lever 4 rotates in the direction indicated by an arrow E to press the fixing pin 5 upward. The fixing pin 5 thus pressed upward is inserted into the first hole 8*a* formed on the lower end of the carriage 1. The flange 5*a* of the fixing pin 5 abuts upon the carriage 1 under pressure to enable the carriage 1 to be fixed in the longitudinal direction of the guide shaft 11, and at the same time, the fixing pin 5 presses the carriage 1 upwardly to enable the carriage to rotate in the clockwise direction around the guide shaft 11 as shown in FIG. 5. This motion to press the carriage 1 to rotate is regulated by the stopper 10 on the carriage side provided for the carriage 1 and the stopper 6 on the recovery unit side provided for the recovery unit main body 3 when these stoppers abut upon each other. By the series of the operations as described above, the carriage 1 is fixed. Then, the suction cap 7 is raised by means of a driving means which is not shown to enable it to contact the first recording head 15*a* and cover its discharging ports airtightly. Thus, the usual suction (recovery operation) is executed so that the ink in the first recording head 15*a* is sucked by the suction cap 7. When the recovery operation for the first recording head 15*a* is completed, the cam 2 rotates in the direction opposite to the direction indicated by the arrow C, so that the part of the lever on the cam 2 side is pressed upward to cause the fixing pin 5 to retract from the first hole 8*a*. The carriage 1 descends to the initial position to be supported by the shaft 33. Here, the empty suction is executed to suck the ink in the suction cap 7 together with the air, and then, the suction cap 7 descends to leave the first recording head 15*a* at the same time.

When the carriage 1 descends to the initial position, the carriage 1 is shifted in the direction indicated by the arrow B and suspended at the second fixing position as given where the second recording head 15*b* faces the suction cap 7. Then, in the same manner as the series of the operations described above, the cam 2 rotates in the direction indicated by the arrow C to press the fixing pin 5 upward. The upwardly pressed fixing pin is inserted into the second hole 8*b* this time, so that the carriage 1 is fixed in the longitudinal direction of the guide shaft 11 and the rotation of the carriage 1 is regulated. In this state, the usual suction (recovery operation) is executed for the second recording head 15*b*. After the recovery operation is executed for the second recording head 15*b*, an empty suction is conducted. Then, the recovery operations for the third and fourth recording heads 15*c* and 15*d* are further executed in the same manner as the foregoing series of operation. This time, the third and fourth holes 8*c* and 8*d* are utilized, respectively. Then, the recovery operations for the recording heads 15*a* to 15*d* are completed in this way.

In order to conduct the operation of the protective cap when the recording apparatus is not in use, the carriage 1 is at first shifted in the direction indicated by an arrow B to the fifth fixing position as given (protective capping position) where the first to fourth recording heads 15*a* to 15*d* face the first to fourth caps 14*a* to 14*d* of the protective cap 9.

Then, the cam 2 incorporated in the recovery unit main body 3 rotates in the direction indicated by the arrow C. The extrusion 2*a* of the cam 2 is caused to disengage from the extrusion 4*a* of the lever 4. Thus, by the tension of the coil spring 12, the lever 4 rotates in the direction indicated by the arrow C to press the fixing pin 5 upward. The upwardly pressed fixing pin 5 is inserted into the fifth hole 8*e* formed on the lower end of the carriage 1. The carriage 1 is fixed in the longitudinal direction of the guide shaft 11, and at the same time, the fixing pin 5 presses the carriage 1 upwardly and causes the carriage 1 to rotate around the guide shaft 11. This motion to press the carriage 1 for its rotation is regulated by the stopper 10 on the carriage side provided for the carriage 1 and the stopper 6 on the recovery unit side provided for the recovery unit main body 3 side which abut upon each other. By the series of the operations as described above, the protective cap 7 is raised by a driving means which is not shown after the carriage 1 has been fixed. Then, the first to fourth caps 14*a* to 14*d* are held closely in contact with the first to fourth recording heads 15*a* to 15*d*, respectively; hence covering the respective discharging ports to complete the head protective capping.

Figure 7:
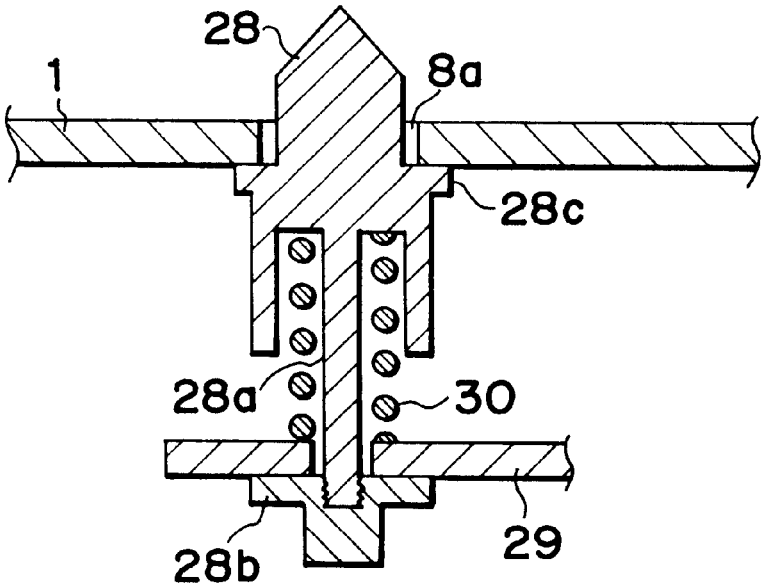
FIG. 7 is a vertical sectional view schematically showing a variation of the carriage fixing unit according to the first embodiment.

FIG. 7 is a vertical sectional view schematically showing a variation of the carriage fixing part according to the first embodiment.

As shown in FIG. 7, a hole is formed on one end of the lever 29 on the suction cap (not shown) side. A fixing pin 28 having a flange 28*c* is provided with a small-diameter shaft 28*a*, and this shaft 28*a* passes through the aforesaid hole of the lever 29. Then, a screw 28*b* is threaded over the lower end of the shaft 28*a*. Between the fixing pin 28 and lever 29, a coil spring 30 is provided so that the fixing pin 28 is biased upwardly. This coil spring 30 serves as a buffering member to buffer the impact exerted when the fixing pin 28 is inserted into the hole 8*a* of the carriage 1 so that the carriage 1 is raised to bring the stopper (not shown) on the recovery unit side and the stopper (not shown) on the carriage side to abut upon each other.

(Second Embodiment)

Figure 8:
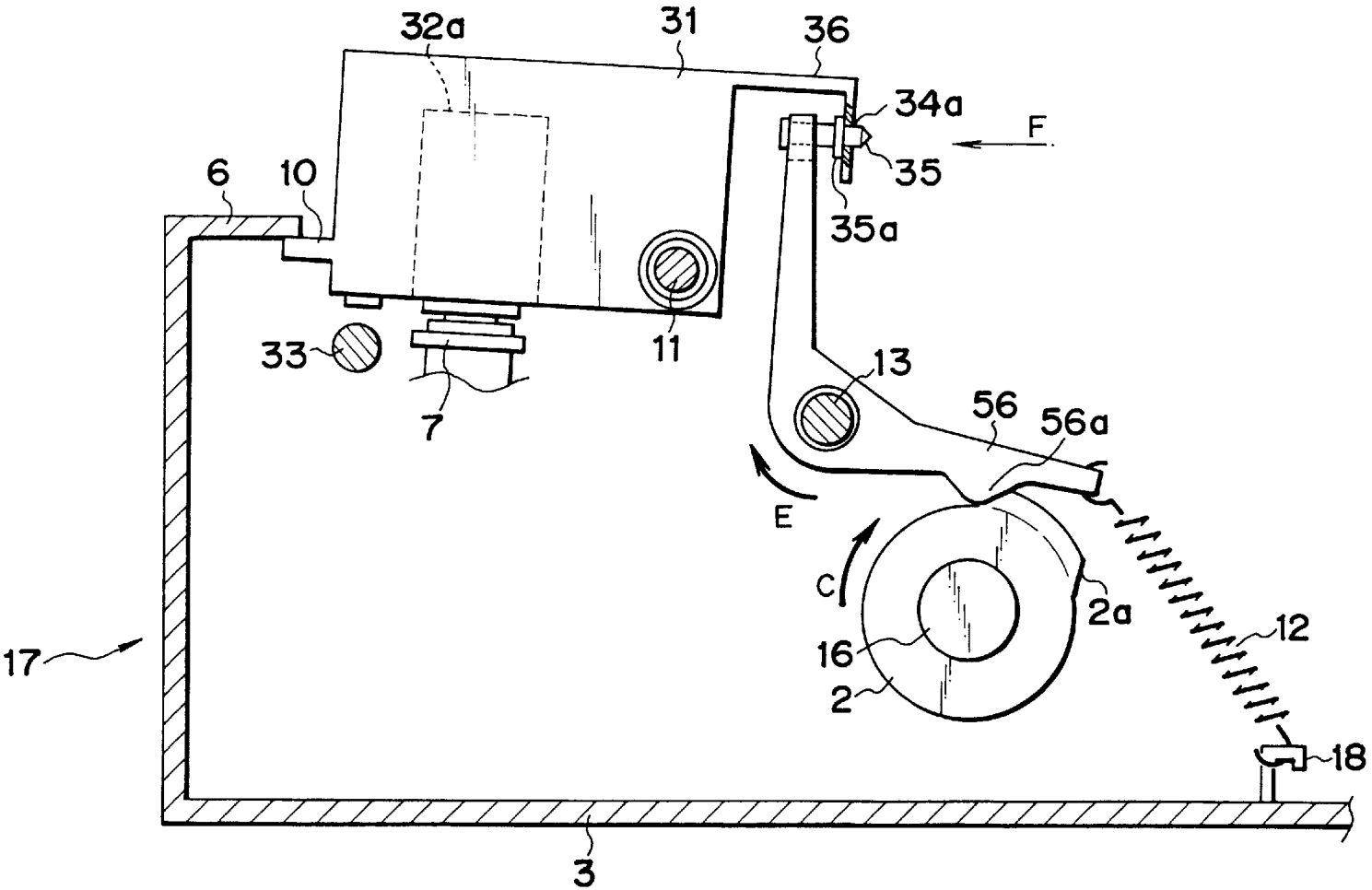
FIG. 8 is a vertical sectional view schematically showing a second embodiment of the carriage, recovery unit, and others according to the present invention.
Figure 9:
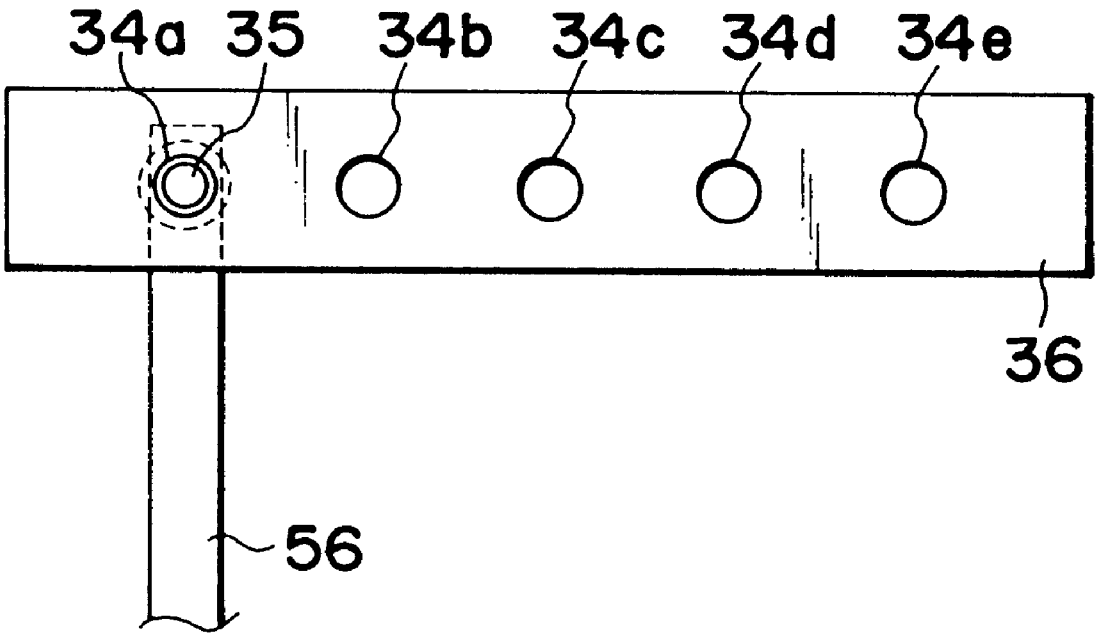
FIG. 9 is a schematic view showing the carriage fixing unit in FIG. 8 observed in the direction indicated by an arrow F.

FIG. 8 is a vertical sectional view schematically showing the carriage, recovery unit, and others which are the characteristic parts of a second embodiment of the recording apparatus according to the present invention. FIG. 9 is a schematic view showing the carriage fixing unit shown in FIG. 8 observed in the direction indicated by an arrow F.

As shown in FIG. 8, according to the present embodiment, a lever 56 is bent almost at 90° and formed in an L-letter shape when observed from its side. The structure is so arranged that the lever 56 pulls a carriage 31 in the right-hand direction in FIG. 8 and fixes it. To describe this structure further in detail, the extrusion 36 made of a plate in an L-letter shape is integrally formed with the rear part of the carriage 31 as shown in FIG. 8 and FIG. 9. On this extrusion 36, the first to fifth holes 34*a* to 34*e* (refer to FIG. 9) are formed in the same manner as the first to fifth holes 8*a* to 8*e* (refer to FIG. 4) of the first embodiment. The other structures are the same as the first embodiment.

Now, the operation of the present embodiment will be described.

As shown in FIG. 8 and FIG. 9, the carriage 31 is shifted to the recovery unit 17 side in order to execute the first recovery operation for the first recording head 32*a*. When the first recording head 32*a* is brought to the first fixing position as given where the first recording head 32*a* faces the suction cap 7, and is suspended, the cam 2 incorporated in the recovery unit main body 3 rotates in the direction indicated by an arrow C. Thus, the extrusion 2*a* of the cam 2 is caused to disengage from the extrusion 56*a* of the lever 56. By the tension of the coil spring 12, the lever 56 rotates in the direction indicated by an arrow E. A fixing pin 35 is inserted into the first hole 34*a* formed on the lower end of the carriage 31. The flange 35*a* of the fixing pin 35 abuts on the extrusion 36 of the carriage 31. In this way, the carriage 31 is fixed in the longitudinal direction of the guide shaft 11. At the same time, the carriage 31 is pulled to the right-hand side in FIG. 8 and rotates in the direction indicated by the arrow E around the guide shaft 11. This motion to rotate the carriage 31 is regulated by the stopper 10 on the carriage side provided for the carriage 31 and the stopper 6 on the recovery unit side provided for the recovery unit main body 3 which abut upon each other. With the series of the operations described above, the carriage 31 is fixed, and then, the suction cap 7 is raised by a driving means which is not shown to allow it to contact the first recording head 32*a* airtightly. Thus, the usual suction (recovery operation) is executed. When the recovery operation of the first recording head 32*a* is completed, the cam 2 rotates in the direction opposite to the direction indicated by the arrow C. The lever 56 on the cam 2 side is pressed upward to cause the fixing pin 35 to retract from the first hole 34*a*. The carriage 31 descends to the initial position. Here, the empty suction of the suction cap 7 is executed, and then, the suction cap 7 descends to leave the first recording head 32*a*.

Subsequently, in order to execute the rotational operation of the second recording head (not shown) the carriage 31 is shifted along the guide shaft 11 to the second fixing position as given where the second recording head faces the suction cap 7.

Then, as in the foregoing series of the operations, the cam 2 rotates in the direction indicated by the arrow C so that the fixing pin 35 is shifted to the right-hand side in FIG. 8 to be inserted into the second hole 34*b* (refer to FIG. 9) of the carriage 31. Thus, the carriage 31 is fixed in the longitudinal direction of the guide shaft 11 and the rotation of the carriage 31 is regulated. In this state, the usual suction (recovery operation) is executed for the second recording head in the same manner as described above. After the recovery operation for the second recording head, the empty suction of the suction cap 7 is conducted. Further, the recovery operations for the third and fourth recording heads (not shown) are executed. The recovery operation is executed by the same series of the operations as described above, but the third and fourth holes 34*c* and 34*d* are used, respectively, this time. In this way, the recovery operations for the four recording heads are completed.

In order to execute the operation of the protective cap when the recording apparatus is not in use, the carriage 31 is at first shifted along the guide shaft 11 to the fifth fixing position as given (protective capping position) where the first to fourth recording heads face the first to fourth caps of the protective cap, respectively.

Then, the cam 2 incorporated in the recovery unit main body 3 rotates in the direction indicated by the arrow C. The extrusion 2*a* of the cam 2 is caused to disengage from the extrusion 33*a* of the lever 56. Thus, by the tension of the coil spring 12, the lever 56 rotates in the direction indicated by the arrow E.

The fixing pin 35 is shifted in the right-hand side in FIG. 8 to be inserted into the fifth hole 34*e* formed on the lower end of the carriage 31. The carriage 31 is fixed in the longitudinal direction of the guide shaft 11, and at the same time, the carriage 31 is pulled to the right-hand side in FIG. 8 to rotate around the guide shaft 11. This motion to rotate the carriage 31 is regulated by the stopper 10 on the carriage side provided for the carriage 1 and the stopper 6 on the recovery unit side provided for the recovery unit main body 3 which abut upon each other. With the series of the operations described above, the carriage 31 is fixed, and then, when the protective cap (not shown) is raised by means of the driving means which is not shown, the first to fourth caps of the protective cap contact the first to fourth recording heads airtightly, thus completing the protective capping for the heads.

The second embodiment differs from the first embodiment in that the holes are arranged for the extrusion 36 which is the plate overhanging to the rear part of the carriage 31, while the lever 56 is bent almost at 90°. With the second embodiment, it is possible to fix the carriage effectively in a case where there is not much space on the lower end of the carriage but on the rear part thereof. Also, it may be possible to apply the variation shown in FIG. 7 to the second embodiment.

(Third Embodiment)

Figure 10:
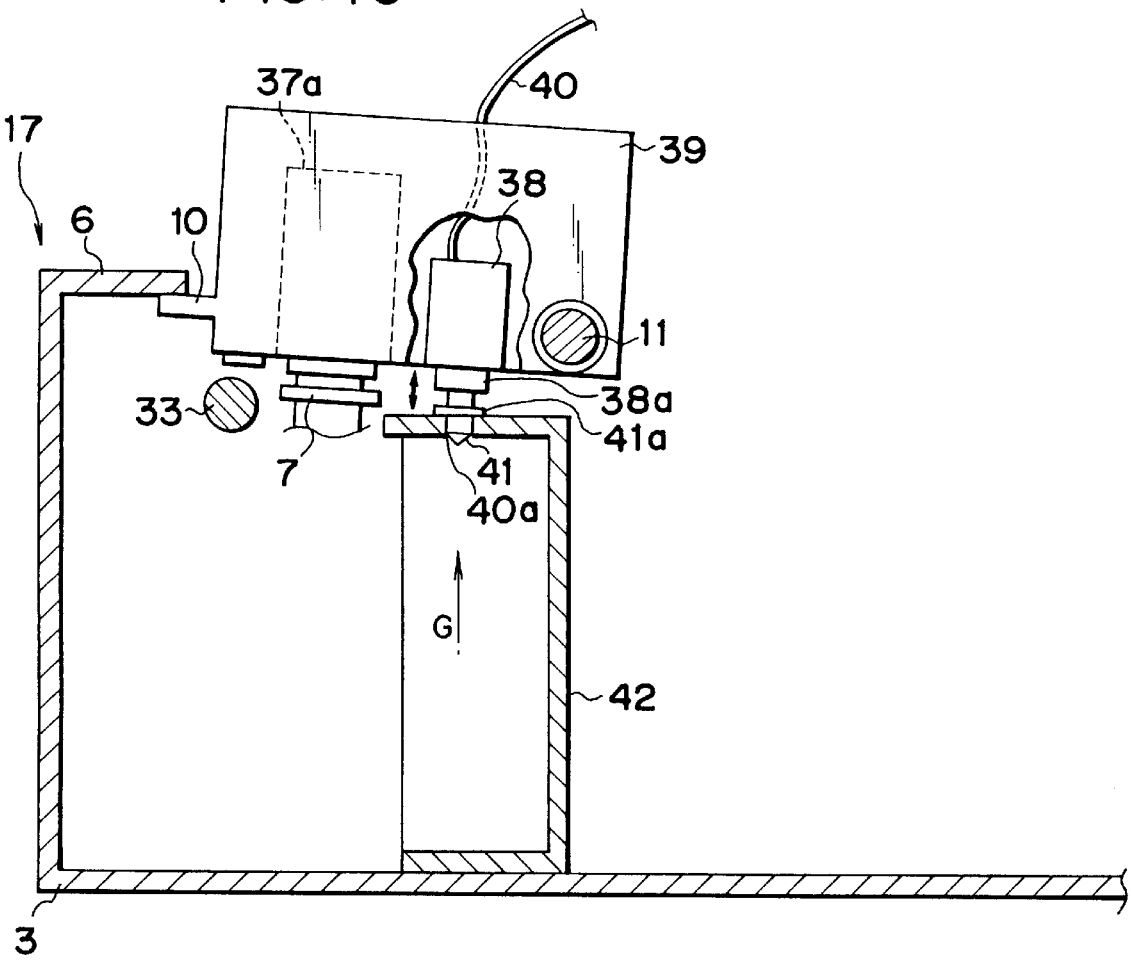
FIG. 10 is a vertical sectional view schematically showing a third embodiment of the carriage, recovery unit, and others according to the present invention.
Figure 11:
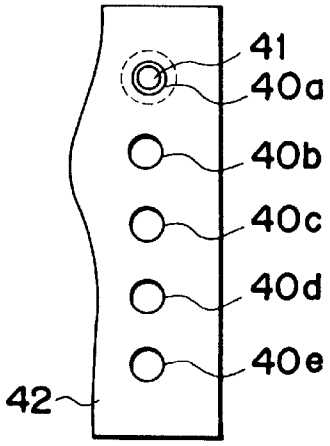
FIG. 11 is a schematic view showing the carriage fixing unit in FIG. 10 observed in the direction indicated by an arrow G.

FIG. 10 is a vertical sectional view schematically showing the carriage and recovery unit which are the characteristic parts of a third embodiment of the recording apparatus according to the present invention. FIG. 11 is a schematic view showing the carriage fixing unit shown in FIG. 10 observed in the direction indicated by an arrow G.

As shown in FIG. 10, according to the present embodiment, an electromagnetic plunger 38 is provided as fixing means on the rear part of the mounting position of a carriage 39*a* for a recording head 37*a*. To the output shaft 38*a* of this electromagnetic plunger 38, a fixing pin 41 having a flange 41*a* is fixed. The electromagnetic plunger 38 is connected to an excitation means, which is not shown, through a line 40. A control unit (not shown) controls whether the electromagnetic plunger 38 is to be excited or demagnetized. Below the carriage 39, there is positioned a plate 42 which is fixed to the recovery unit main body 3. On the upper part of this plate 42, the first to fifth holes 40*a* to 40*e* (refer to FIG. 11) are formed similarly to the first to fifth holes 8*a* to 8*e* in the first embodiment. All the other constructions are the same as those of the first embodiment.

Now, the operation of the present embodiment will be described.

As shown in FIG. 10 and FIG. 11, in order to execute the recovery operation for the first recording head 37*a*, the carriage 39 is shifted to the recovery unit 17 side. When the first recording head 37*a* comes to the first fixing position as given where it faces the suction cap 7, the control means (not shown) controls the aforesaid excitation means to cause the electromagnetic plunger 38 to be excited. Its output shaft 38*a* then descends together with the fixing pin 41. The descending fixing pin 41 is inserted into the first hole 40*a* of the plate 42. The fixing pin 41*a* abuts upon the upper end of the plate 42 under pressure. Hence, the carriage 39 is fixed in the longitudinal direction of the guide shaft 11. At the same time, the fixing pin 41 functions to press the carriage 39 in the upward direction so that the leading end of the carriage 39 (in the left-hand side in FIG. 10) is raised around the guide shaft 11. This motion to raise the carriage is regulated by the stopper 10 on the carriage side provided for the carriage 39 and the stopper 6 on the recovery unit side provided for the recovery unit main body 3 which abut upon each other.

With the above-mentioned series of operations, the carriage 39 is fixed. Then, the recovery operation for the first recording head 37*a* is executed by the suction cap 7. When this operation is completed, the electromagnetic plunger 38 is demagnetized by the aforesaid excitation means. The fixing pin 41 is then raised to retract from the first hole 40*a* of the plate 42 so that the carriage 1 returns to the state before the execution of the above-mentioned series of operations. Here, the empty suction of the suction cap 7 is executed. Then, the suction cap 7 descends to leave the first recording head 37*a*. As in the first and second embodiments, the same series of operations are executed for the remaining second to fifth holes 40*b* to 40*e*, hence completing the recovery operations and the protective capping.

The third embodiment is essentially different from the first and second embodiments in that the fixing pin and its driving systems are arranged on the carriage side (using an electromagnetic plunger as means to generate its driving force), while the holes are formed on the recovery unit side.

(Fourth Embodiment)

Figure 12:
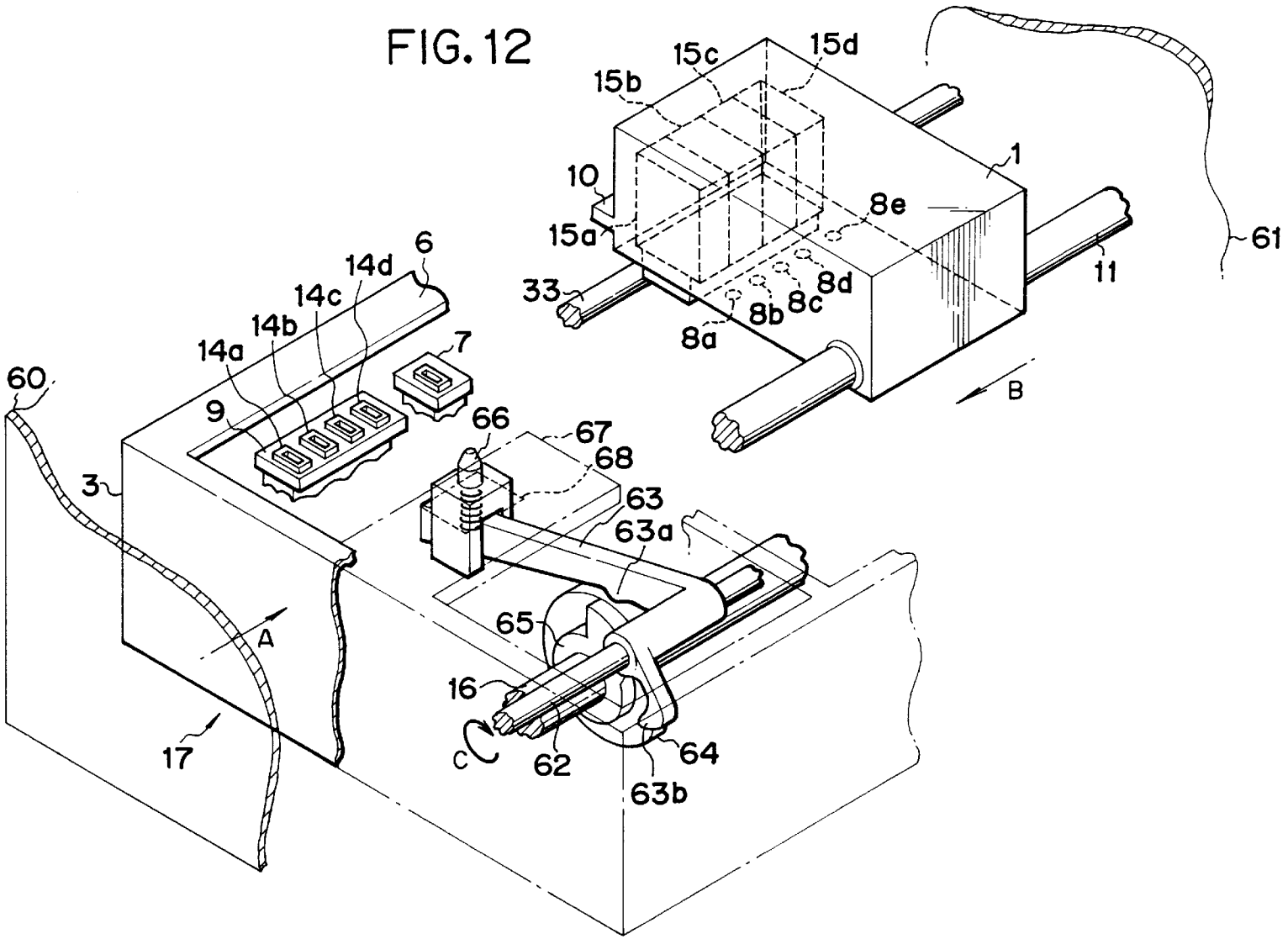
FIG. 12 is a perspective view schematically showing the carriage, recovery unit, and others according to a fourth embodiment of the recording apparatus of the present invention.
Figure 13:
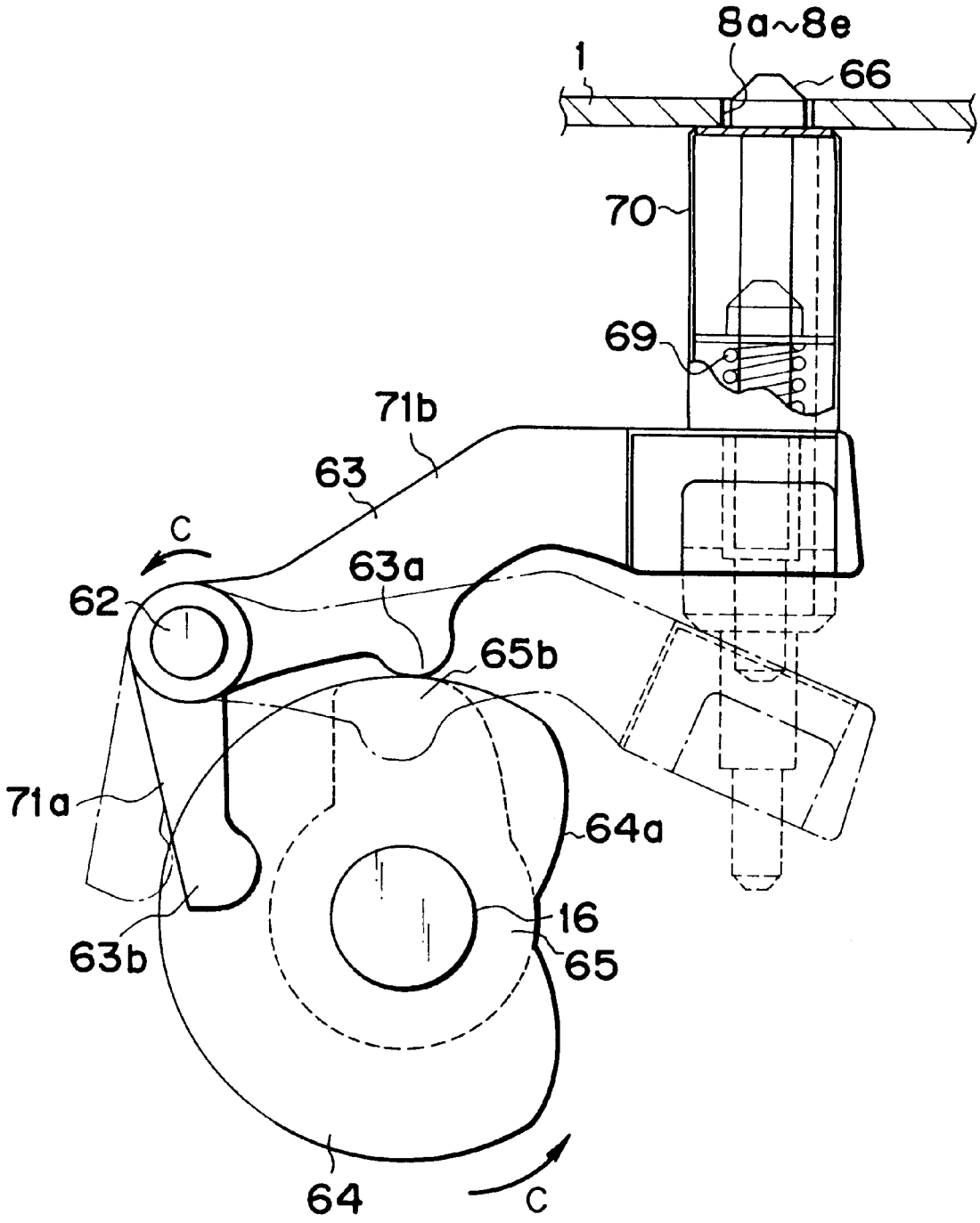
FIG. 13 is a detailed view schematically illustrating the fixing pin driving unit shown in FIG. 12.

FIG. 12 is a view illustrating a fourth embodiment of the recording apparatus according to the present invention, which is the same figure as FIG. 4. FIG. 13 is a detailed view illustrating the driving unit of the fixing pin shown in FIG. 12. In this respect, FIG. 13 represents a state that the fixing pin engages with a hole formed on the carriage.

The lever 63 formed in an L-letter shape when observed from the side is rotatively supported by a shaft 62, both ends of which are fixed in the recovery unit main body 3. On the longer side 71*b* and shorter side 71*a* of this lever 63, extrusions 63*a* and 63*b* are formed, respectively. Also, at the leading end of the longer side 71*b* of the lever 63, a fixing pin 66 is integrally formed. Also, there is movably arranged in the vertical direction, a supporting member 70 which is biased by a coil spring 69 upwardly. This supporting member 70 is supported by the lever 63 through the coil spring 69, and also, arranged to pass through a hole 68 of an extruded piece formed on the recovery unit main body 3. The supporting member is guided by this hole 68 to move vertically.

For the rotational shaft 16 driven by a cam driving motor (not shown) to rotate, the integrally formed two cams, first and second cams 64 and 65, are arranged together. These first and second cams 64 and 65 are also provided with a recess 64*a* and an extrusion 65*b*, respectively. The first cam 64 presses the extrusion 63*a* formed on the longer side 71*b* of the lever 63 upwardly to enable the lever 63 to rotate in the direction indicated by an arrow C (the state represented by FIG. 13). On the other hand, the second cam 65 presses the extrusion 63*b* formed on the shorter side 71*a* of the lever 63 upwardly to enable the lever 63 to rotate oppositely in the direction indicated by the arrow C. All the other structures are the same as those of the first embodiment.

Now, the operation of the fourth embodiment will be described.

As shown in FIGS. 12 and 13, the extrusion 63*b* of the shorter side 71*a* of the lever 63 is pressed upward by the extrusion 65*b* of the second cam 65 in the initial state. Meanwhile, the extrusion 63*a* of the longer side 71*b* of the lever 63 abuts on the recess 64*a* of the first cam 64. Thus, the longer side 71*b* of the lever 63 is in the descending position. In order to execute the recovery operation of the first recording head 15*a*, the carriage 1 is shifted to the recovery unit 17 side, that is, in the direction indicated by an arrow B. When the first recording head 15*a* is suspended at the first fixing position as given where it faces the suction cap 7, this event is detected by a position detection sensor (not shown). Thus, the first and second cams 64 and 65 rotate oppositely to the direction indicated by the arrow C by a cam driving motor (not shown) which is controlled by a control unit (not shown). In this way, the extrusion 65*b* of the second cam 65 disengages from the extrusion 63*b* of the lever 63. At the same time, the recess 64*a* of the first cam 64 also disengages from the extrusion 63*a* of the lever 63. Consequently, the longer side 71*b* of the lever 63 is pressed upward by the first cam 64. Also, the fixing pin 66 is pressed upward. The upwardly pressed fixing pin 66 is inserted into the first hole 8*a* formed on the lower end of the carriage 1, and then, the supporting member 70 abuts upon the carriage 1 under pressure exerted by the resiliency of the coil spring 69, hence enabling the carriage 1 to rotate around the guide shaft 11. This motion to raise the carriage 1 for its rotation is regulated when the stopper 10 on the carriage side provided for the carriage 1 abuts upon the stopper 6 on the recovery unit side provided for the recovery unit main body 3. With the above-mentioned series of operations, the carriage 1 is fixed. Then, the suction cap 7 is raised by a driving means, which is not shown, to allow it to contact the first recording head 15*a* airtightly for covering its discharge ports. The usual suction (recovery operation) is executed to suck the ink in the first recording head 15*a* by means of the suction cap 7. When the recovery operation for the first recording head 15*a* is completed, the first and second cams 64 and 65 rotate in the direction indicated by the arrow C. Thus, the extrusion 63*a* of the longer side 71*b* of the lever 63 abuts upon the recess 64*a* of the first cam 64, while the extrusion 63*b* of the shorter side 71*a* of the lever 63 abuts upon the extrusion 65*b* of the second cam 65 and it is raised. The lever rotates reversely in the direction indicated by the arrow C and enables the fixing pin 66 to retract from the first hole 8*a*. Hence, the carriage 1 descends to the initial position to be supported by the shaft 33. Here, the empty suction is executed to suck the ink in the suction cap 7 together with the air. At the same time, the suction cap 7 descends to leave the first recording head 15*a*.

When the carriage 1 descends to the initial position, the carriage 1 is shifted in the direction indicated by the arrow B and suspended at the second fixing position as given where the second recording head 15*b* faces the suction cap 7 in order to execute the recovery operation for the second recording head 15*b*. Then, as in the foregoing series of operations, the first and second cams 64 and 65 rotate reversely in the direction indicated by the arrow C. The fixing pin 66 is pressed upward. The fixing pin 66 thus pressed is inserted into the second hole 8*b* of the carriage 1 this time to allow the carriage 1 to be fixed in the longitudinal direction of the guide shaft 11 and regulate the rotation of the carriage 1. In this state, the usual suction (recovery operation) is executed for the second recording head 15*b*. After the recovery operation for the second recording head 15*b*, the empty suction is executed. Further, the recovery operations for the third and fourth recording heads 15*c* and 15*d* are executed in the same manner as the foregoing series of operations, but this time the third and fourth holes 8*c* and 8*d* are used, respectively. In this way, the recovery operations for the four recording heads 15*a* to 15*d* are completed.

When the protective capping operation is executed while the recording apparatus is out of use, the carriage 1 is at first shifted in the direction indicated by the arrow B to the position where the first to fourth caps of the protective cap 9 face the first to fourth recording heads 15*a* to 15*d*, respectively.

Then, the first and second cams 64 and 65 incorporated in the recovery unit main body 3 rotate reversely in the direction indicated by the arrow C to press the fixing pin 66 upward. The fixing pin 66 thus raised is inserted into the fifth hole 8*e* formed on the lower end of the carriage 1. Hence, the carriage 1 is fixed in the longitudinal direction of the guide shaft 11. At the same time, the fixing pin 66 presses the carriage 1 upward to allow the carriage 1 to rotate around the guide shaft 11. This motion to raise the carriage 1 for its rotation is regulated when the stopper 10 on the carriage side provided for the carriage 1 abuts upon the stopper 6 on the recovery unit side provided at the fifth fixing position as given (protective capping position) where the recovery unit main body 3 faces the caps 14*a* to 14*d*. With the above-mentioned series of operations, the carriage 1 is fixed, and then, the protective cap 7 is raised by a driving means which is not shown. Thus, the first to fourth caps 14*a* to 14*d* contact the first to fourth recording heads 15*a* to 15*d* to cover the respective discharging ports airtightly and complete the protective capping for the heads.

In the present embodiment, the lever is almost in an L-letter shape. In addition, compared to the second embodiment shown in FIG. 8, it is possible to make the apparatus smaller because the provision of the coil spring and lock is not needed.

Figure 14:
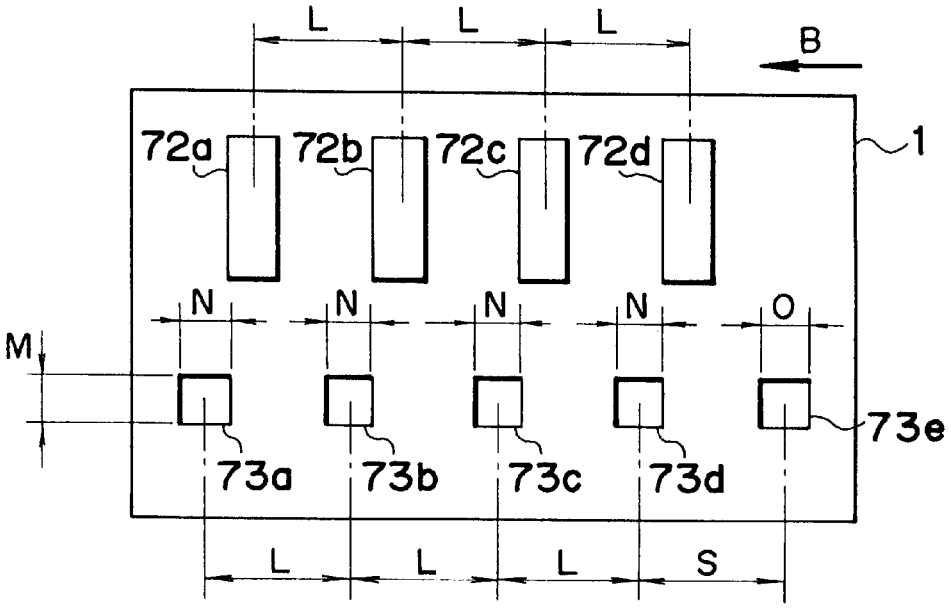
FIG. 14 is a bottom view of a variation of the carriage of the recording apparatus according to the present invention.
Figure 15:
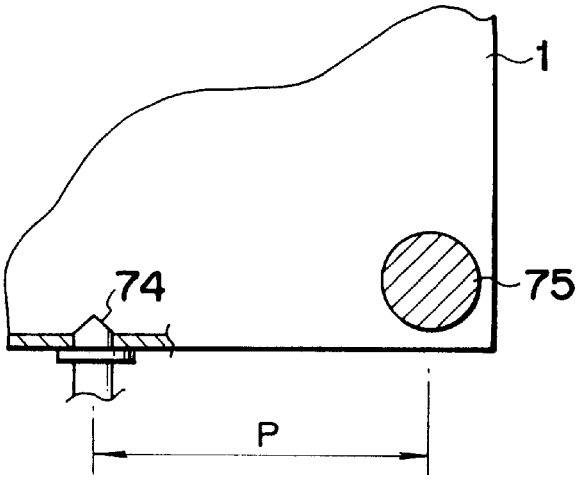
FIG. 15 is a view schematically showing the carriage fixing unit of the present variation.
Figure 16A:
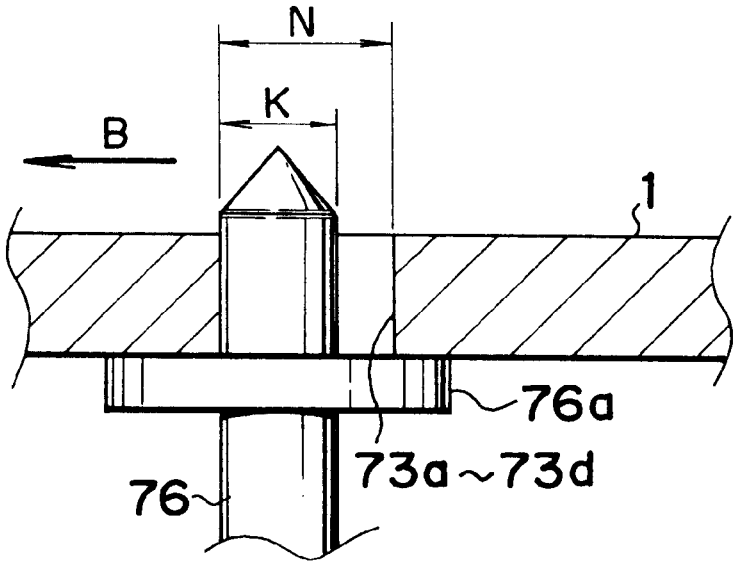
FIGS. 16A and 16B are schematic views showing the present variation which is in a state of the normal suction.
Figure 16B:
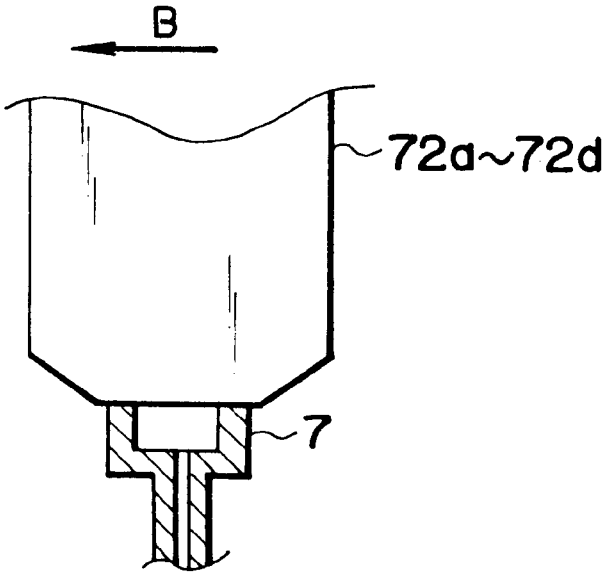
Figure 17A:
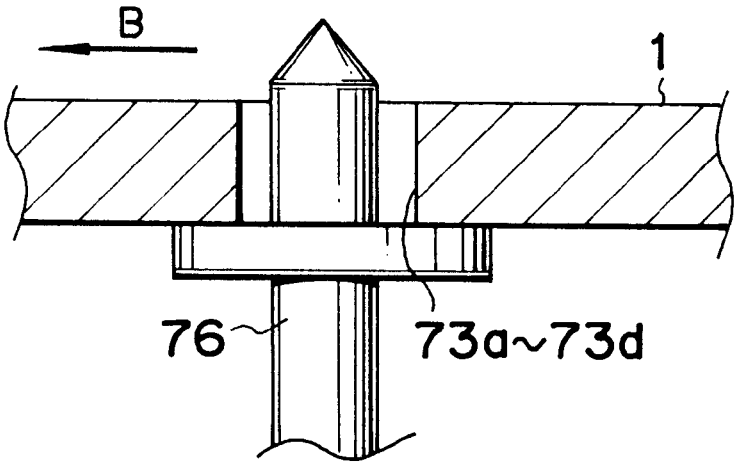
FIGS. 17A and 17B are schematic views showing the present variation which is in a state of the empty suction.
Figure 17B:
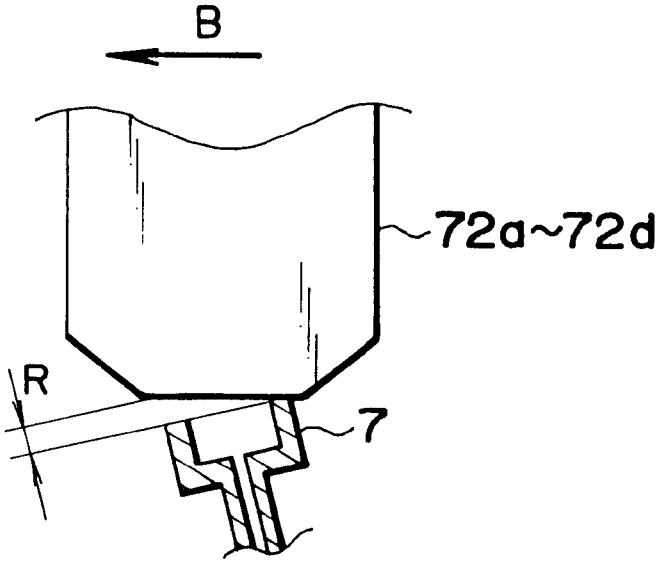

FIG. 14 is a bottom view schematically showing a variation of the recording apparatus according to the present invention. FIG. 15 is a schematic view showing the carriage fixing unit of this variation. FIGS. 16A and 16B are views schematically showing the state of this variation at the time of the usual suction. FIG. 16A is a cross-sectional view schematically showing the carriage fixing unit by means of a fixing pin. FIG. 16B is a schematic view showing the suction cap and recording heads. Also, FIGS. 17A and 17B are views schematically showing the state of this variation at the time of the empty suction. FIG. 17A is a cross sectional view schematically showing the carriage fixing unit by means of a fixing pin. FIG. 17B is a schematic view showing the suction cap and recording heads.

As shown in FIG. 14, the four recording heads, the first, second, fourth, and fifth heads 72*a* to 72*d*, which can discharge ink of cyan, magenta, yellow, and black, respectively, are arranged on the carriage 1 in a row at intervals L (12.7 mm each). The four holes, the first, second, third, and fourth holes 73*a* to 73*d*, which are used at the time of suction, are also formed on the carriage 1 at intervals L. Each of the length M and width N of these first, second, third, and fourth holes 73*a* to 73*d* is 2.71 mm and 2.5 mm, respectively. Also, the fifth hole 73*e* which is used at the time of protective capping is formed in a position apart from the fourth hole 73*d* by a distance S (10 mm). The length M and width O of this hole are 1.7 mm, respectively. The present embodiment is characterized in that the shape of the first, second, third, fourth, and fifth holes 73*a* to 73*e* is rectangular, and that the diameter K of the fixing pin is 1.65 mm as shown in FIG. 16A and is sufficiently smaller than the width N (2.5 mm) of each of the first, second, third, and fourth holes 73*a* to 73*d*. In this way, according to the present embodiment, the usual suction of the recording heads 72*a* to 72*d* is executed by the suction cap 7 as shown in FIG. 16, and then, the carriage 1 is shifted in the direction indicated by the arrow B by a fine distance in the state that the fixing pin 76 is inserted into the first, second, third, and fourth holes 73*a* to 73*d*, so that the empty suction can be executed by the suction cap 7 from the recording heads 72*a* to 72*d* after the suction cap 7 has been inclined as shown in FIG. 17. All the other structures are the same as those of the first embodiment.

Now, the operation of the present embodiment will be described in detail.

As shown in FIG. 16A, when the carriage 1 is suspended at the first fixing position as given, the fixing pin 76 is inserted into the first hole 73*a* of the carriage 1 which is located in the left side end in FIG. 16A. The carriage 1 is fixed in its scanning direction. In this state, the suction cap 7 contacts the recording head 72*a* airtightly, and the usual suction is executed to suck the ink by the suction cap 7 from the first recording head 72*a* as shown in FIG. 16B. At this juncture, as shown in FIG. 15, the distance P between the fixing pin 76 and guide shaft 75 is 42.9 mm. After the completion of the usual suction, the fixing pin 76 still remains in the first hole 73*a* according to the present embodiment as shown in FIG. 17A, and the carriage 1 is shifted in the direction indicated by the arrow B for an extremely short distance. Then, the fixing pin 76 is positioned almost in the center of the first hole 73*a*. On the other hand, the suction cap 7 is pulled by the carriage 1 to cause the cap to be inclined because the one end (not shown) of the cap is rockably supported as shown in FIG. 17B. In this way, a clearance R is provided between the first recording head 72*a* and suction cap 7. In this state, the empty suction is executed to suck the ink in the suction cap 7 together with the air. Then, the fixing pin 76 retracts from the first hole 73*a*. At the same time, the suction cap 7 descends to execute the same operations as those described above for the ink suction of the other recording heads 73*b*, 73*c*, and 73*d*. The other operations are the same as those of the first embodiment.

In the present embodiment, it is possible to execute the empty suction immediately after the usual suction. Also, a direct current motor is usually used as a carriage driving motor, but the response of the direct current motor tends to fluctuate when the carriage is repeatedly shifted in a short distance. This fluctuation makes it impossible to position the carriage exactly as intended. According to the present embodiment, however, the foregoing fluctuations can be absorbed because the diameter of the fixing pin is sufficiently smaller than the width of the hole provided for the carriage.

In each of the above-mentioned embodiments, fixing means is arranged between a carriage and recovery unit, but the arrangement is not necessarily limited thereto. There is no problem functionally even if the fixing means is arranged between the recording heads themselves and the recovery unit, and the other member.

Also, the present invention is applicable not only to an ink jet recording apparatus, but to the recording apparatus of a wire dot type or laser beam type. Also, the present invention is applicable to a recording apparatus in which its carriage is supported by the guide shaft but not rotatively. Further, the given fixing positions of the carriage are not necessarily limited to the capping position. These positions may be arranged at a standby position.

Now, the description will be made of a mechanism capable of preventing a carriage and a guide rail from being bent due to the operation or the like to be executed by a user. Each of the embodiments set forth below is the one which is good enough to achieve the objectives of the present invention. Also, each of the embodiments set forth above is effective enough in achieving the objectives of the present invention, but being applied in combination with either one of the following embodiments, it is possible for any one of them to demonstrate further effects. In this respect, the arrangement positions of the recovery unit and carriage fixing means in the recording apparatus are not the same between the above-mentioned first to fourth embodiments and the following fifth to seventh embodiments. However, there is no difference at all in the functional effects which will be produced by any one of them according to the present invention.

(Fifth Embodiment)

Figure 18:
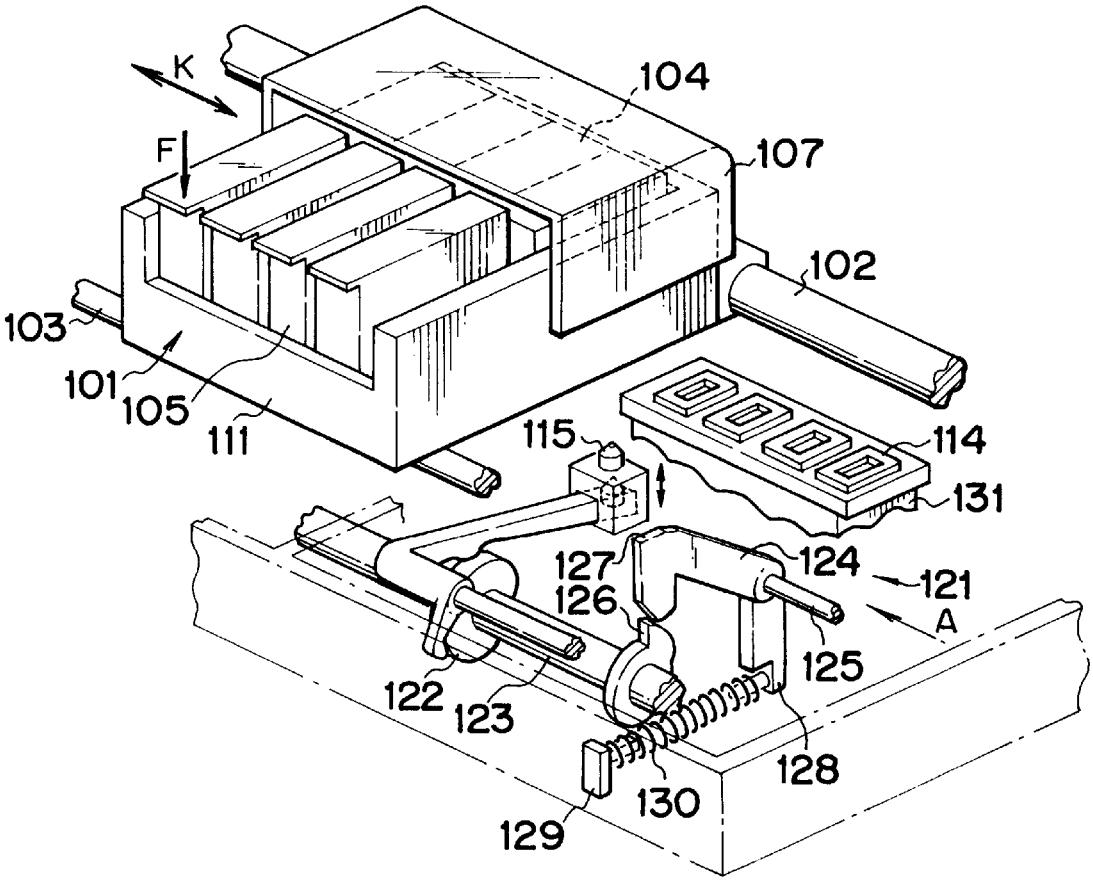
FIG. 18 is a partial perspective view schematically illustrating the principle structure of a fifth embodiment of the recording apparatus to which the present invention is applicable.
Figure 19:
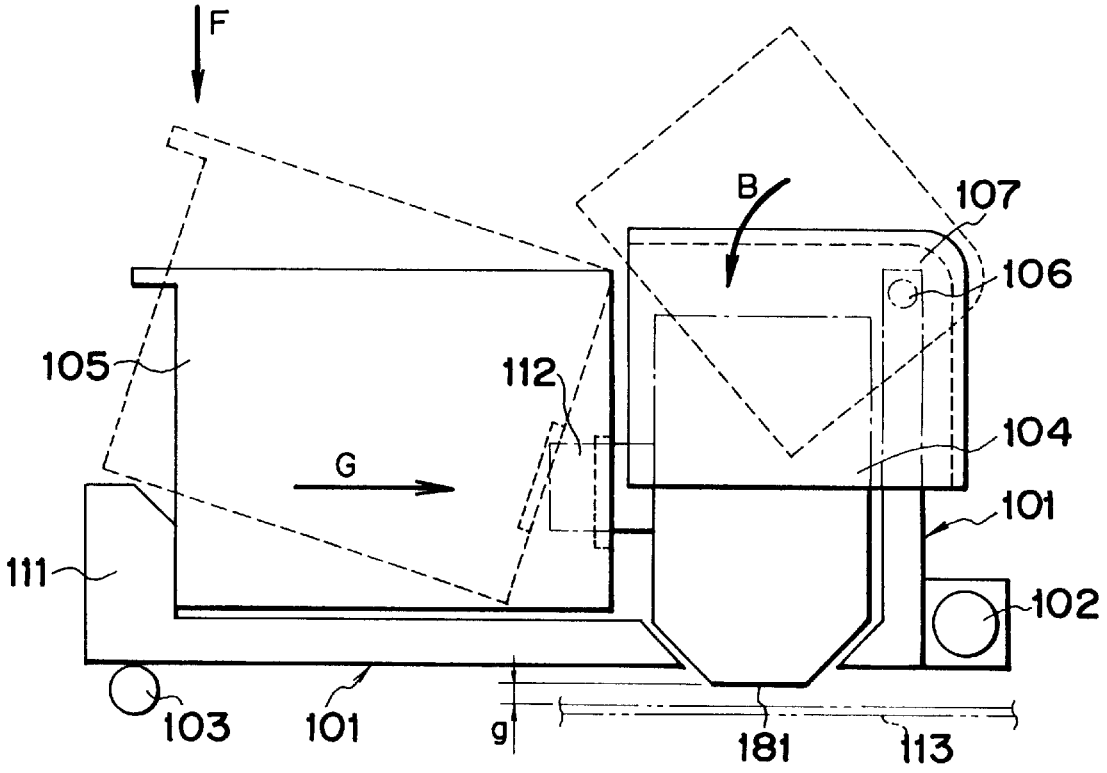
FIG. 19 is a schematic side view illustrating the state of attaching and detaching a recording head and ink tank to and from the carriage of the recording apparatus shown in FIG. 18.
Figure 20:
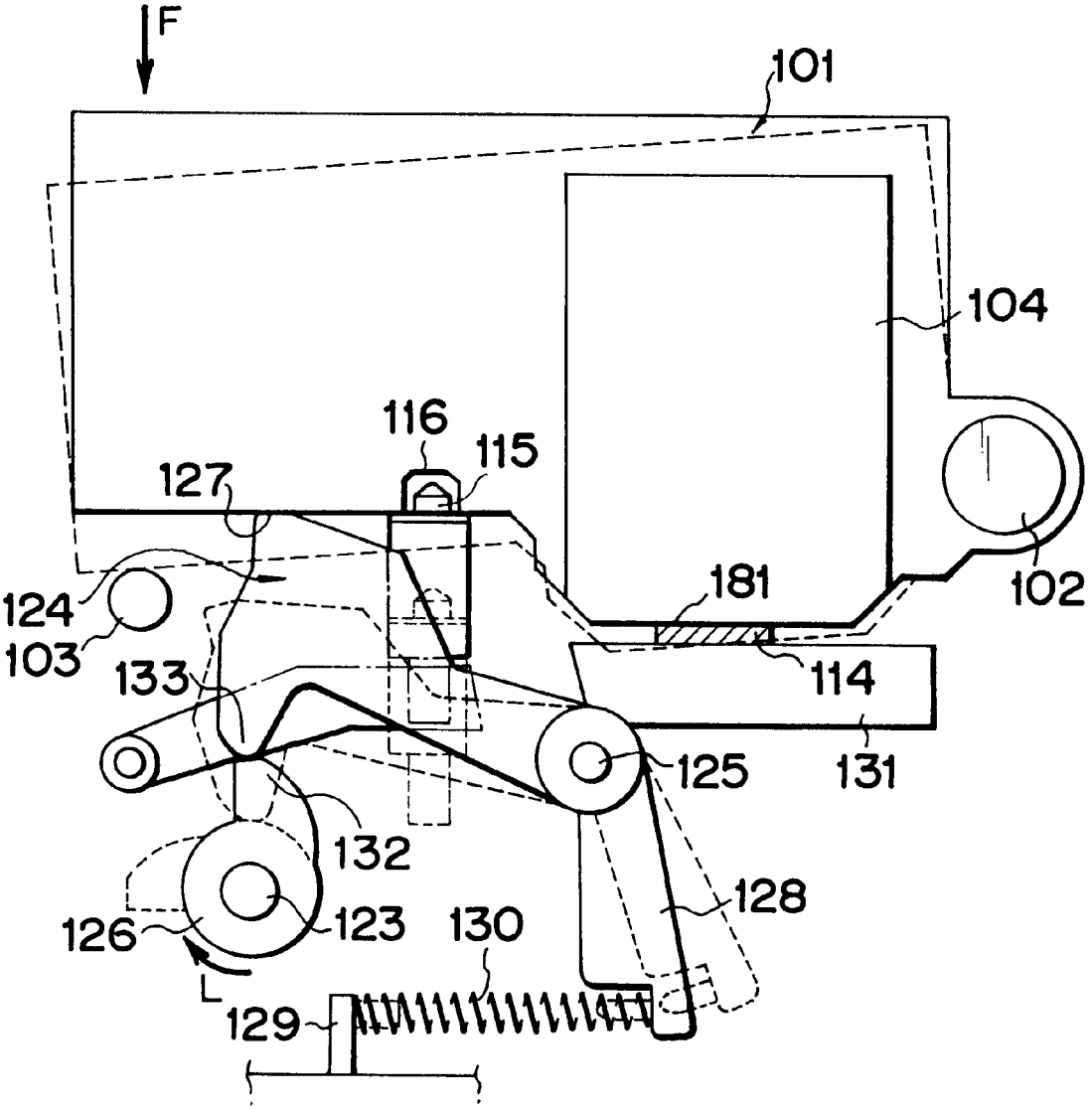
FIG. 20 is a schematic side view showing the structure and operation of a mechanism which positions and supports the carriage in its standby position in the recording apparatus shown in FIG. 18.

Hereinafter, with reference to the accompanying drawings, the description will be made of the other embodiments according to the present invention. FIG. 18 is a partial perspective view schematically showing the principle structure of a fifth embodiment of the recording apparatus to which the present invention is applicable. FIG. 19 is a schematic side view showing a state of an ink tank attached to or detached from the recording apparatus shown in FIG. 18 observed in the direction indicated by an arrow A. FIG. 20 is a schematic side view showing the structures of the carriage fixing means and supporting means in the recording apparatus shown in FIG. 18 observed in the direction indicated by an arrow A. Here, in the application hereof, the same or equivalent members are referenced by the same reference marks. Also, in the following embodiments, the description will be made of the case where an ink jet recording apparatus is exemplified as the recording apparatus.

In FIG. 18 to FIG. 20, a carriage 101 is supported by a guide rail 102 and a supporting shaft 103 fixed to the apparatus main body so that the carriage is guided to reciprocate. On the carriage 101, recording means (recording head) 104 and an ink tank (ink cartridge) 105 mounted attachable to or detachable from the carriage 101. In the present embodiment, four recording heads 104 and four ink tanks 105 each corresponding to each of the recording heads 104 are mounted. In a case of a color recording, each of the recording heads 104 and ink tanks 105 are arranged to record in each different color of ink such as black, cyan, magenta, and yellow. Also, in the present embodiment, the carriage 101 is supported and guided to reciprocate along the guide rail 102, and at the same time, its rotation around the guide rail 102 is regulated by the supporting shaft 103. The carriage 101 is coupled to a transmission belt or the like which is not shown, for example, and is able to reciprocate by means of this belt which is driven by a motor (not shown).

To the carriage 101, a head cover 107 is mounted rotatively (open and closed) around the boss 106. This head cover 107 serves to position and hold the recording heads 104 in a given position on the carriage 101. Here, each of the recording heads 104 are fixed on the carriage 101 in a state that each of them is properly positioned by rotating the head cover 107 in the direction indicated by an arrow B so that the cover is closed and set at its closed position. The head cover 107 is locked (fixed) to the carriage 101 in the aforesaid closed position. Also, when the head cover 107 is rotated reversely to the direction indicated by the arrow B to open it, the recording heads 104 and the ink tanks 105 can be set in a state that these can be removed easily. In other words, the structure is so arranged that handling the head cover 107 enables the recording heads 104 to be easily attached to or detached from the carriage 101.

The ink tanks 105 can be easily positioned on the carriage 101 when pressed in the direction indicated by an arrow F with respect to the carriage 101 in a state that the tanks are sandwiched between an ink tank pressing unit 111 and the joint 112 of the recording heads 104 by the application of the supporting force exerted in the direction indicated by an arrow G by the ink tank pressing unit 111 of the carriage 101. In this positioning state thus fixed, the ink flow passages are formed between the ink tanks 105 and recording heads 104 airtightly, and ink is supplied from the corresponding ink tanks 105 to the recording heads 104, respectively. Also, the ink tanks 105 can be easily detached from the carriage 101 by raising the tanks in the direction reverse to that indicated by the arrow F.

The carriage 101 is supported to be able to reciprocate along the guide rail 102 in the direction indicated by an arrow K and also guided and supported rotatively around the guide rail 102. The guide rail 102 is supported by the recording apparatus main body. The recording heads 104 are mounted in the carriage 101 in a downward posture. In a case of an ink jet recording apparatus, a give space (gap) g is provided between the front end (discharging port surface) of the recording heads 104 and a recording material 113 (FIG. 19) such as a recording sheet.

In FIGS. 18 and 20, a recovery unit 121 for maintaining and recovering the discharging capability of the discharging ports 182 is arranged at the standby position of the carriage 101 or in its vicinity which is out of the recording area of the recording apparatus. This recovery unit 121 is provided with a cap 114 to airtightly cover (capping) the discharging port surface 181 in order to prevent the ink in the discharging ports 182 from being dried as well as the dust particles from adhering to the discharging port surface 181, a suction pump (not shown) to suck the ink from the discharging ports 182 by generating a negative pressure in the cap 114 in a capping state, and others. Then, the arrangement is made so that the recovery operation is executed for the recording heads 104 in the standby position. Here, the cap 114 is installed on a cap holder 131.

In the carriage standby position, a fixing pin 115 is provided, which enables the carriage 101 to be positioned in the standby position. In the vicinity of the standby position of the carriage 101, there is arranged a transmission shaft 123 which is driven to rotate by the driving force from the recovery unit 121. The fixing pin 115 is vertically movable by means of a fixed pin cam 122 provided for the transmission shaft 123. Then, when the carriage 101 travels to the standby position, the fixing pin 115 fits in a hole 116 formed on the reverse side of the carriage 101 (as the holes **8*a* to 8*d* in the above-mentioned first to fourth embodiments, for example). Then, the structure is made to set the carriage 101** in a given position by pressing the pin further upward.

Here in the standby position of the carriage 101, a carriage supporting lever 124 is provided to constitute supporting means according to the present invention. This supporting lever (supporting member) 124 is rotatively supported around a shaft 125, and arranged to be rotationally driven by means of the supporting lever cam 126 provided for the aforesaid transmission shaft 123. For this supporting lever 124, a carriage supporting unit 127 is formed. By the rotation of the supporting lever 124, this carriage supporting unit 127 is moved in the vertical direction. Also, a compression spring 130 is installed between the arm portion on the other end of the supporting lever 124 and a lock 129 on the apparatus main body side. By this compression spring 130, the supporting lever 124 is biased in the direction in which the carriage supporting unit 127 retracts from the reverse side of the carriage 101 (downward direction).

When the recording apparatus enters its standby state after the completion of a recording operation, it is necessary to airtightly close by use of a cap 114 (capping) the discharging port surface 181 of the recording heads 104 which are now out of the recording state. Therefore, after the completion of recording operation, the carriage 101 travels to a given position above the recovery unit 121 having the cap 114 (the standby position=the capping position). Then, the fixing pin 115 is pressed upward by a driving source which is not shown. The fixing pin 115 fits in the hole 116 for positioning the carriage 101, thus allowing the carriage 101 to be raised. In this way, the capping position is set (to allow the cap 114 to abut upon the discharging port surface 181 under pressure). Interlocked with this motion to raise the carriage 101, the supporting lever cam 126 rotates in the direction indicated by an arrow L (FIG. 20).

When the supporting lever cam 126 continuously rotates, the cam extrusion 132 of the supporting lever cam 126 presses the cam abutting part 133 of the carriage supporting lever 124 upward, thus raising the carriage supporting lever 124 around the shaft 125. The supporting lever cam 126 is suspended in a state that the carriage supporting unit 127 of the carriage supporting lever 124 has ascended most, that is, the state where the carriage supporting unit 127 abuts upon the bottom end of the carriage 101. In this suspended state, that is, the carriage supporting lever 124 has been raised most, the fixing pin 115 presses the carriage 101 upward, and at the same time, the cap 114 abuts upon the discharging port surface 181 under pressure for capping. This state then constitutes the standby state of the recording apparatus (carriage 101) according to the present embodiment. In this standby state, the attaching or detaching operation of the ink tanks 105, the gap adjustment operation for the recording heads 104 (the gap adjustment by means of the lever 118 shown in FIG. 29, for example), or other operations to be done on the carriage 101 will be executed.

With the structures and operations described above, even if a force acts on the carriage 101 in the direction indicated by the arrow F when an operation should be done on the carriage 101 (the attachment or detachment of ink tanks 105, for example), it is possible to prevent the carriage 101 from being bent or deformed as well as to position the carriage 101 exactly because the carriage 101 is supported by the fixing pin 115 and the carriage supporting lever 124.

When the above-mentioned standby state is released in order to resume a recording operation or the like, the supporting lever cam 126 is rotated reversely in the direction indicated by an arrow L to bring the cam extrusion 132 not to abut upon the cam abutting part 133. Then, due to the spring force of the compression spring 130, the carriage supporting lever 124 rotates around the shaft 125 to enable the carriage supporting unit 127 to retract from the carriage 101. At the same time, the fixing pin 115 descends to the position where it is not in contact with the carriage 101. The recording heads 104 on the carriage 101 also leave the cap 114, hence releasing the standby state of the carriage 101 to make the recording operation ready.

In other words, when the carriage 101 travels in the main scanning direction in order to execute the recording operation and others, the fixing pin 115 and the carriage supporting lever 124 are in a state (retracted state) in which these are not extended into the traveling space (traveling path) of the carriage 101. Therefore, with the above-mentioned structures, the carriage 101 can be positioned exactly and held reliably in the standby position without any load added anew to the traveling carriage 101 in the scanning direction for the recording operation and others.

Figure 21:
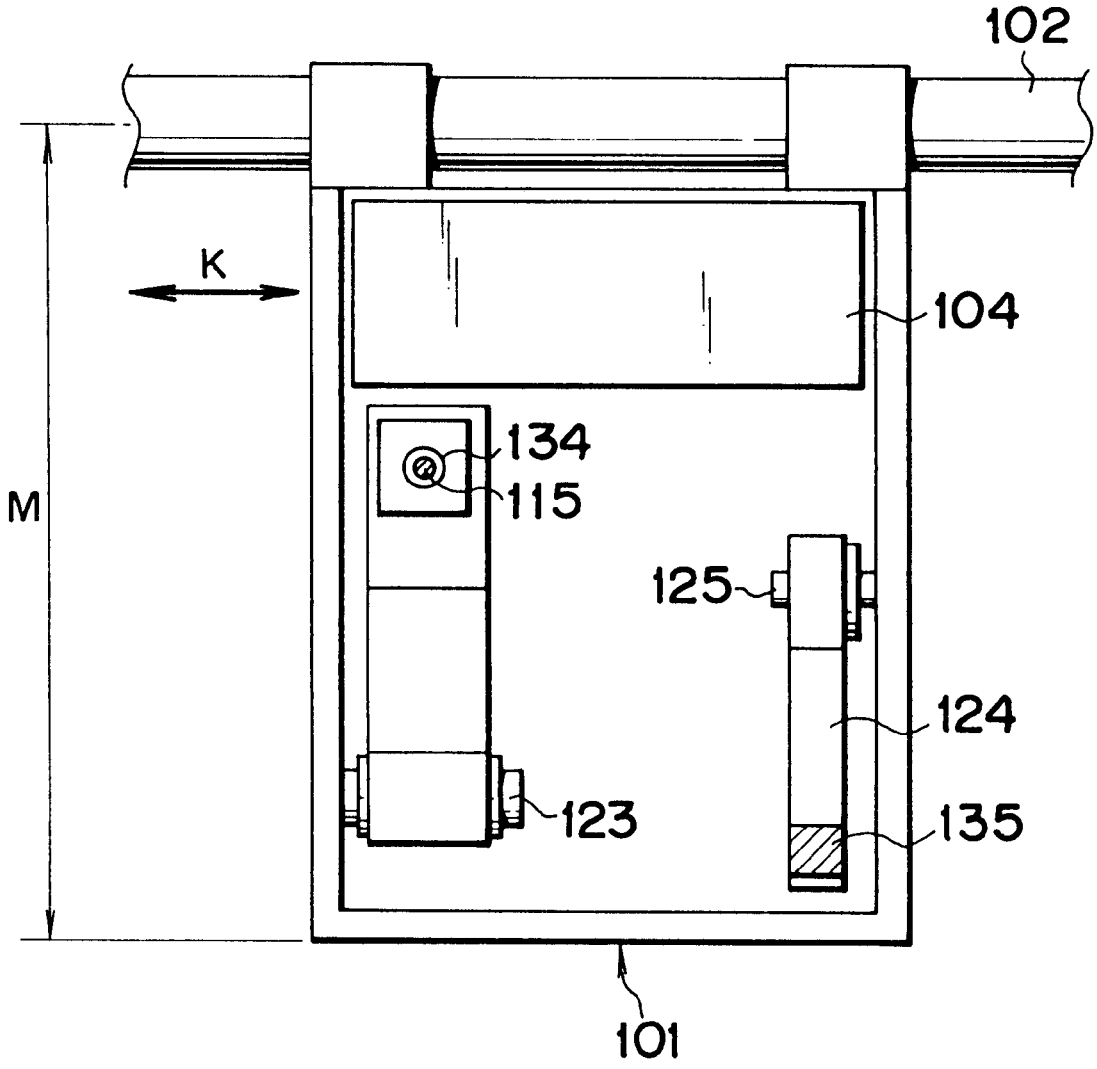
FIG. 21 is a schematic plan view showing the supporting range for the carriage which is in its standby position in the recording apparatus shown in FIG. 18.

FIG. 21 is a plan view schematically showing the fixing and supporting state of the carriage 101 in the standby state with the structures arranged as shown in FIG. 18 to FIG. 20. In FIG. 21, a reference numeral 134 designates the supporting area where the fixing pin 115 abuts upon the carriage 101, while 135, the supporting area where the carriage supporting lever 124 abuts upon the carriage 101. Now, since the aforesaid fixing pin 115 should be provided with a function to position and fix the carriage 101 in the standby position, it is preferable to select the position where the fixing pin 115 and the positioning hole 116 of the carriage 101 are coupled in the vicinity of the discharging port surface 118 or in the vicinity of the guide rail 102. Here, in the present embodiment, the supporting area 134 shown in FIG. 21 is selected as a position to satisfy these conditions.

Meanwhile, it is preferable to select the position where the carriage 101 should be supported by the carriage supporting lever 124 in the vicinity of the end portion on the side opposite to the guide rail 102 from the viewpoint that the entire body of the carriage 101 should be supported by the aforesaid fixing pin 115 and carriage supporting lever 124. Here, in the present embodiment, the supporting area 135 in FIG. 21 is selected as a position to satisfy these conditions. It is particularly effective to select the supporting positions for the carriage support lever 124 in the locations such as these when a carriage 101 is elongated in the horizontal direction (that is, the dimension M in FIG. 21 is long).

According to the embodiment described above, the structure is so arranged that when the carriage 101 arrives at the standby position, the fixing pin 115 and the supporting member (carriage supporting lever) 124 can support the entire body of the carriage 101. As a result, when the attachment, detachment, or replacement of the recording heads 104 and ink tanks 105, the gap adjustment operation for the recording heads 104, or the like should be done on the carriage 101, it becomes possible to prevent the carriage 101 from being bent, hence enabling the required operations on the carriage 101 and the positioning of the carriage 101 to be executed easily and exactly.

Further, the structure is so arranged that when the carriage 101 is out of the standby position, the fixing pin 115 and carriage supporting lever 124 retract from the carriage traveling passage. It is thus possible to obtain the effect that no load is needed for the carriage 101 to travel in the scanning direction, to bring the carriage 101 to the standby position, and to position and hold it in the standby position.

Figure 22:
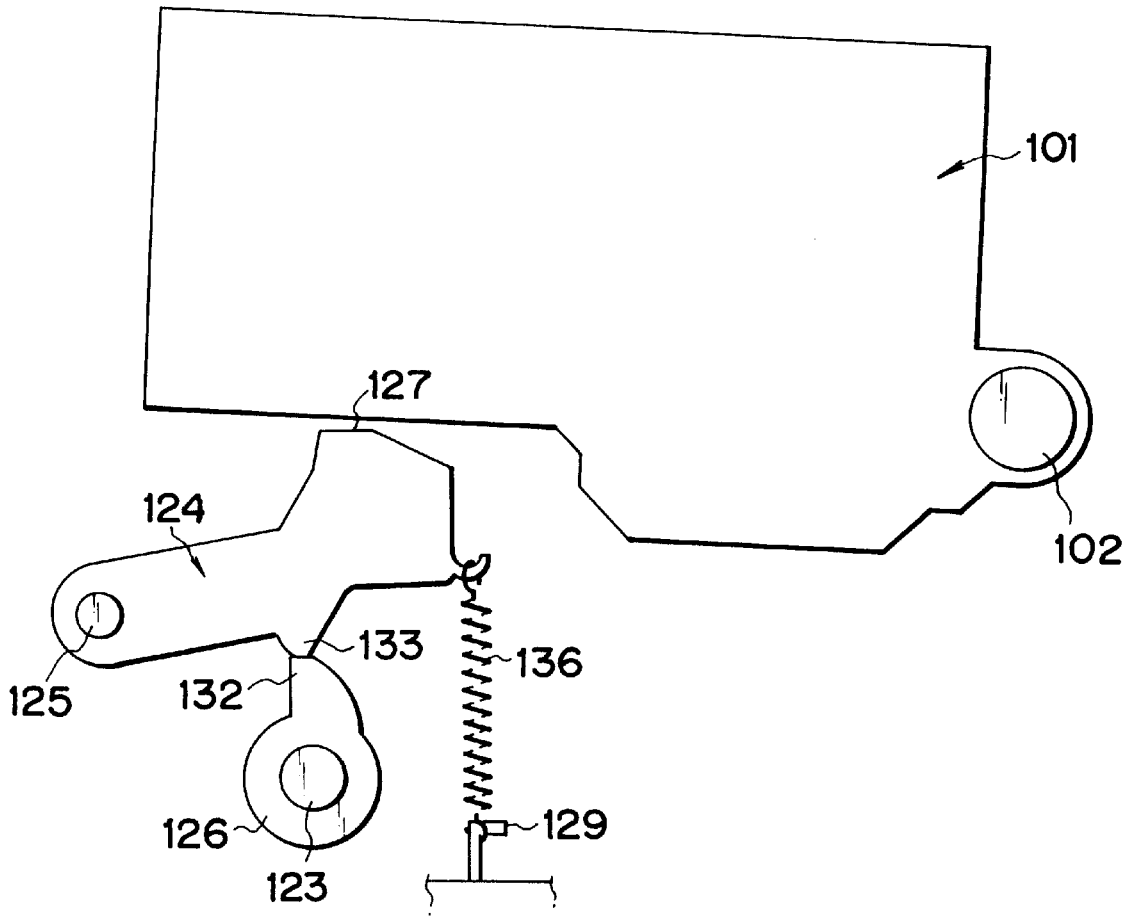
FIG. 22 is a perspective view schematically showing a modified structure of the carriage supporting mechanism of the recording apparatus shown in FIG. 18.

In this respect, according to the foregoing embodiment, it is arranged that the compression spring 130 is adopted to exert the biasing force to bring the carriage supporting lever 124 to the storing position, but a tension spring 136 may be used instead of the compression spring 130 as shown in FIG. 22. In other words, it may be possible to structure so that the vertical movement of the carriage supporting lever 124 is controlled by means of the supporting lever 126 and the aforesaid tension spring 136 after the position of the rotational center 125 of the carriage supporting lever 124 is modified as shown in FIG. 22. Here, the other parts constituting the structure shown in FIG. 22 are the same as those in FIG. 18 and FIG. 20. The corresponding parts are designated by the same reference marks, and the description thereof will be omitted.

Figure 23:
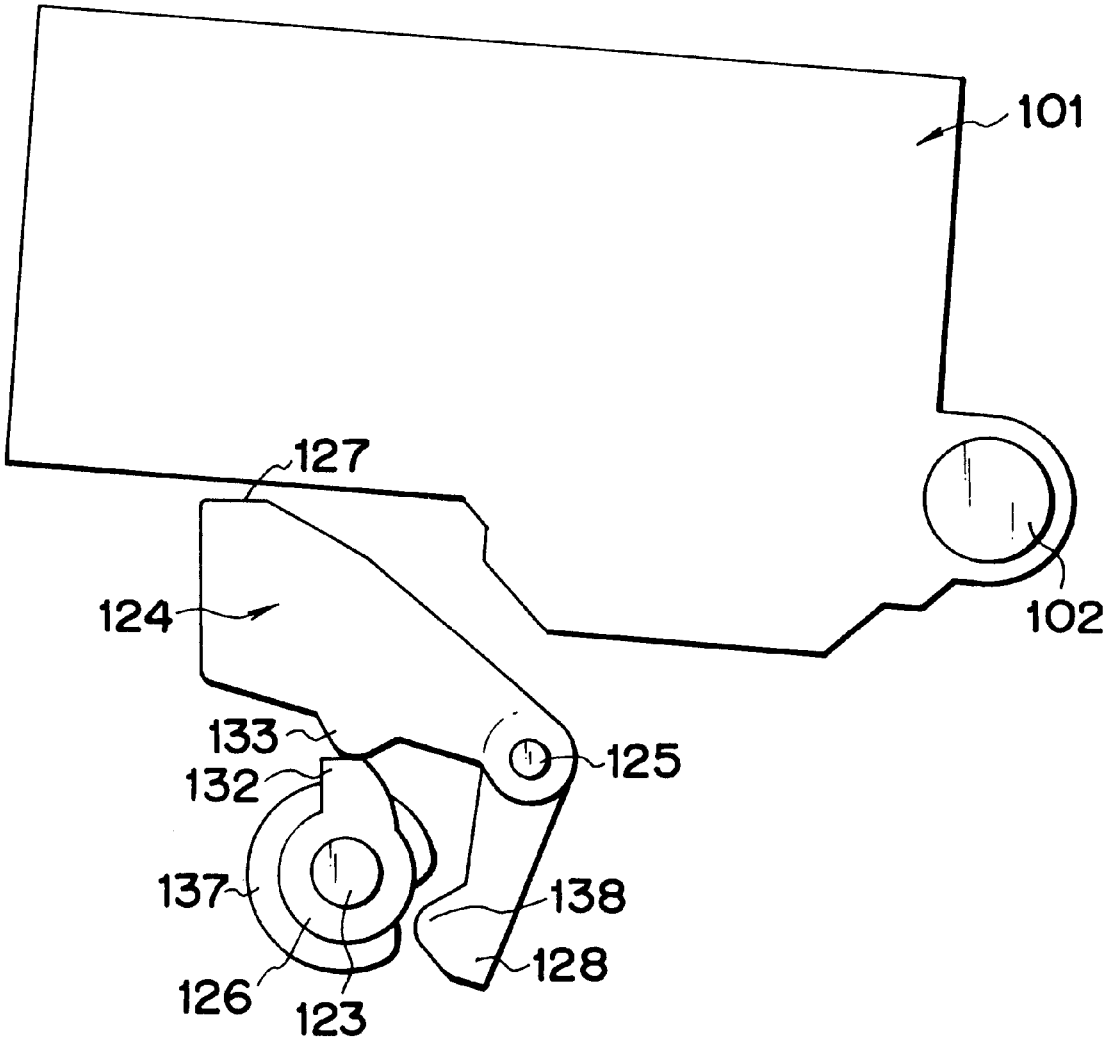
FIG. 23 is a perspective view schematically showing another modification of the structure of the carriage supporting mechanism of the recording apparatus shown in FIG. 18.

Further, as shown in FIG. 23, using the lowering cam 137 provided for the aforesaid transmission shaft 123 instead of the foregoing compression spring 130 or tension spring 136, it may be possible to control the vertical movement of the carriage supporting lever 124 by means of the aforesaid supporting lever cam 126 for lifting and lowering cam 137. Then, in the structure shown in FIG. 23, the cam abutting part 138 which abuts upon the lowering cam 137 is formed on the arm portion 128 on the other end of the carriage supporting lever 124. Here, the other parts of the structure shown in FIG. 23 are the same as those shown in FIG. 18 and FIG. 20. Each of the corresponding parts is designated by the same reference mark, and the description thereof will be omitted.

(Sixth Embodiment)

Figure 24:
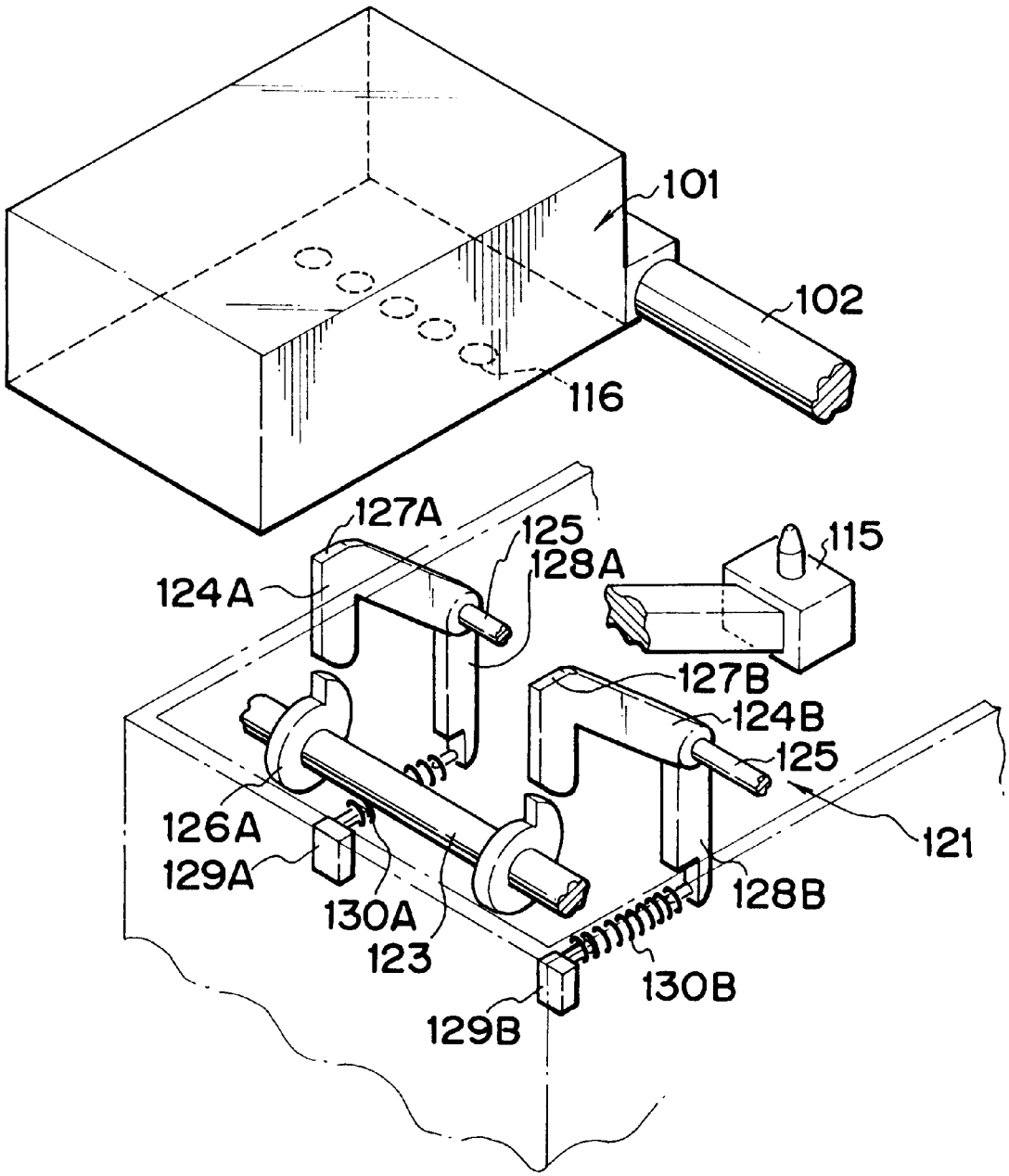
FIG. 24 is a partially perspective view schematically showing the principal structure of a sixth embodiment of the recording apparatus to which the present invention is applicable.
Figure 25:
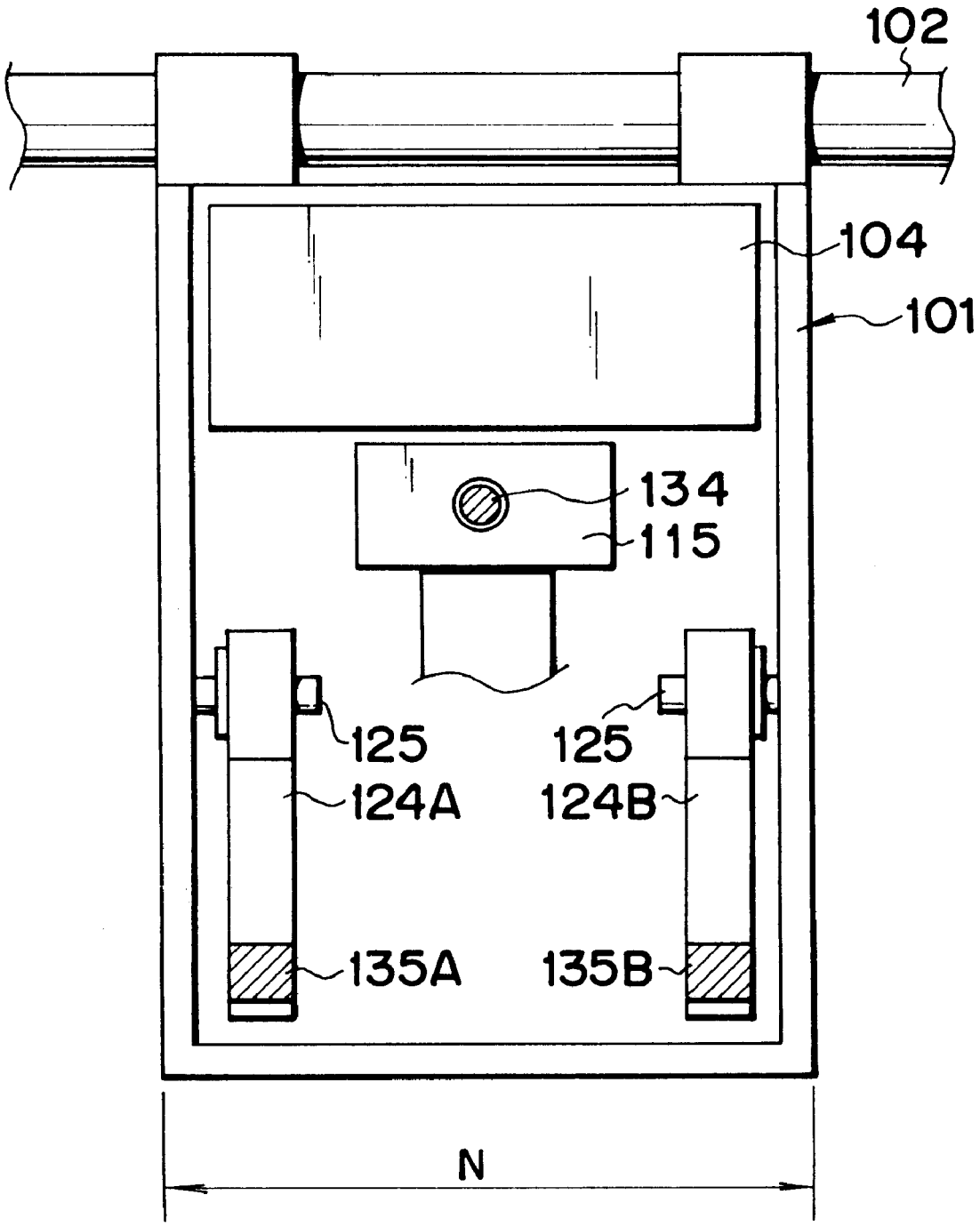
FIG. 25 is a schematic plan view showing the supporting range of the carriage which is in its standby position in the recording apparatus shown in FIG. 24.

FIG. 24 is a partial perspective view schematically showing the principle structure of a sixth embodiment of the recording apparatus to which the present invention is applicable. FIG. 25 is a plan view schematically showing the state where the carriage 101 is fixed and supported in the standby position in the structure shown in FIG. 24. In the present embodiment, it is characterized that the carriage 101 in the standby position is supported by two carriage supporting levers 124A and 124B. With the exception that the aforesaid carriage supporting levers and its driving systems are doubly arranged, the present embodiment has essentially the same structure as the embodiment shown in FIG. 18 to FIG. 21. The carriage 101 in the standby position is then fixed and supported in a total of three locations as shown in FIG. 25, that is, the supporting area 134 by the fixing pin 115, the supporting area 135A by the carriage supporting lever 124A, and the supporting area 135B by the carriage supporting lever 124B.

Also, in the sixth embodiment shown in FIG. 24 and FIG. 25, when the carriage 101 arrives at the standby position, the fixing pin 115 positions and fixes the carriage 101 as in the case of the foregoing fifth embodiment. Interlocked with this, the two carriage supporting levers 124A and 124B support the carriage 101. At the same time, the discharging port surface 181 of the recording heads 104 abuts upon the cap 114 under pressure for the capping of the discharging ports 182. In other words, according to the present embodiment, too, the operations will be executed essentially in the same way as the fifth embodiment.

Therefore, the same functional effects as in the fifth embodiment can be obtained by the present embodiment. In addition, by the carriage 101 being supported by the fixing pin 115 and two other points, it is more advantageous than the fifth embodiment in terms of the prevention of the carriage 101 from being bent or deformed when the force acts on the carriage 101 by the execution of the attachment or detachment of the recording heads 104 and ink tanks 105, the gap adjustment for the recording heads 104, or others.

Also, it is particularly effective to support the carriage 101 in two locations by use of the two supporting levers 124A and 124B as in the present embodiment if there is a need for pressing the location near the center of gravity of the carriage upward by the fixing pin 115 because the carriage 101 weighs a great amount, or the carriage 101 should be supported by the fixing pin 115 in the vicinity of its center as shown in FIG. 25 because the position of the aforesaid positioning hole 116 is restricted due to the unavailability of space on the carriage 101, or further, the carriage 101 is an elongated shape in both directions of the guide rail (the shape which has an N dimension in FIG. 25).

Here, in the sixth embodiment shown in FIG. 24 and FIG. 25, too, it may be possible to adopt the structure shown in FIG. 22 or FIG. 23 in place of the carriage supporting levers 124A and 124B, supporting lever cams 126A and 126B, and springs 130A and 130B. With such a structure, the same functional effects can be obtained of course.

In the sixth embodiment shown in FIG. 24 and FIG. 25, the supporting lever cams 126A and 126B and compression springs 130A and 130B are provided individually corresponding to the two carriage supporting levers 124A and 124B, respectively, but it may be possible to arrange a structure so that the two points of the carriage 101 can be supported simultaneously by one carriage supporting lever (one supporting lever cam and one compression spring) by modifying the configuration of the carriage supporting lever in place of those individually arranged ones. Further, in the present embodiment, while the description has been made of a case where the carriage 101 is supported at two points (at 135A and 135B), it may be possible to arrange a structure so that the carriage 101 can be supported at plural points, three or more, at the same time. It is still possible to obtain by the application of such modifications as these the same functional effects as each of the foregoing embodiments.

(Seventh Embodiment)

Figure 26:
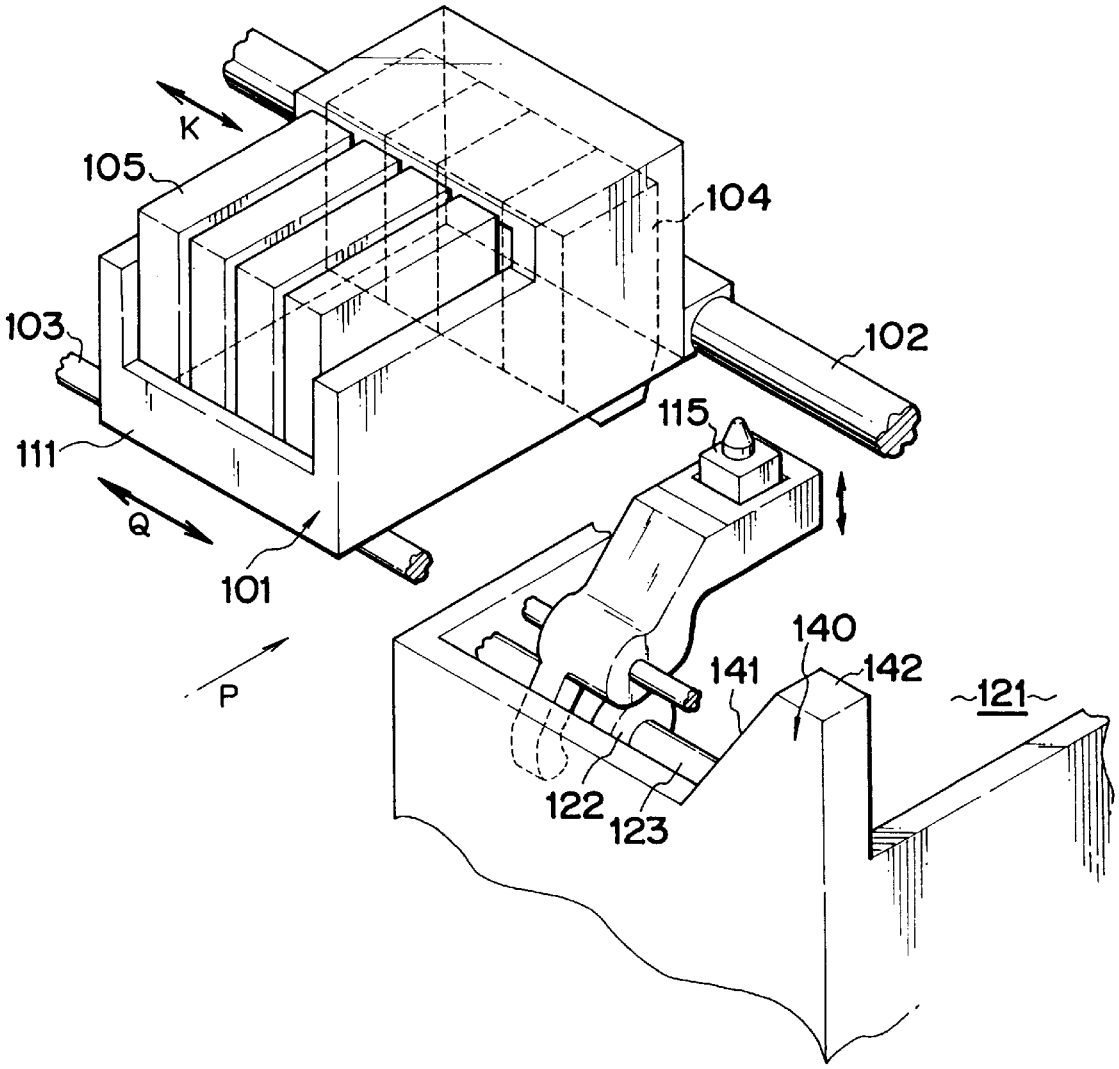
FIG. 26 is a partial perspective view schematically showing the principal structure of a seventh embodiment of the recording apparatus to which the present invention is applicable.
Figure 27:
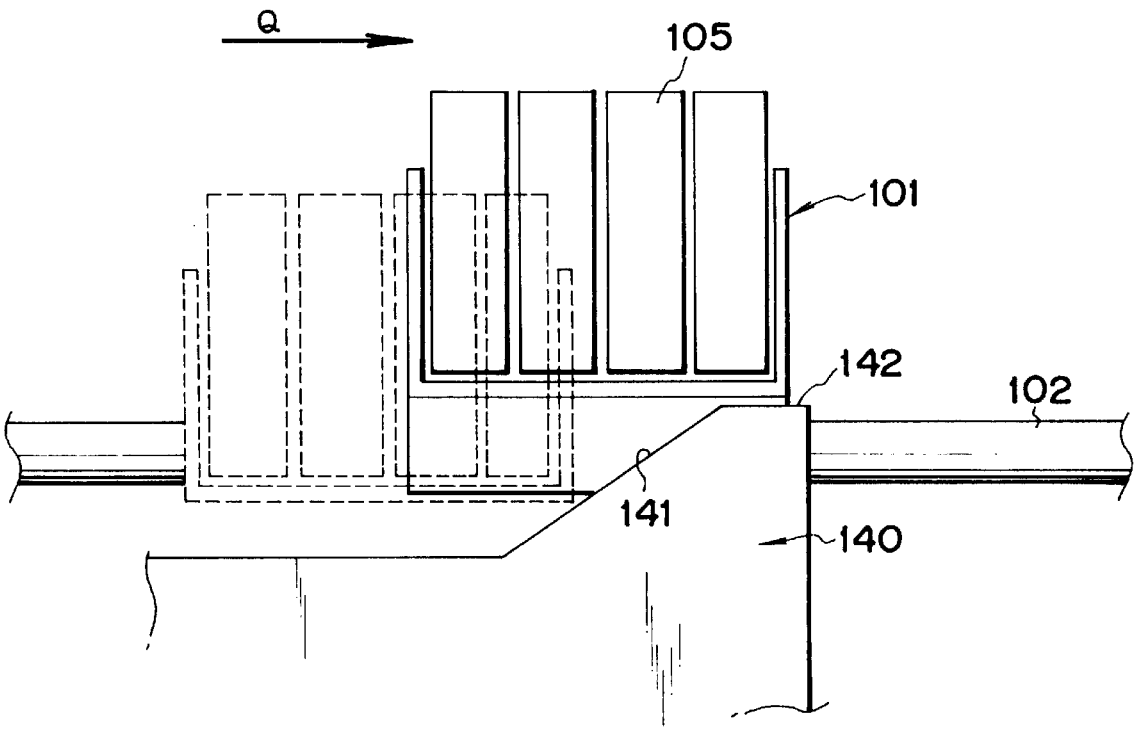
FIG. 27 is a schematic front view showing the state where the carriage enters its standby position in the recording apparatus shown in FIG. 26.

FIG. 26 is a partial perspective view schematically showing the principle structure of a seventh embodiment of the recording apparatus to which the present invention is applicable. FIG. 27 is a schematically partial front view showing the operation of the carriage 101 and the standby state of the carriage 101 shown in FIG. 26 observed in the direction indicated by an arrow P. In the present embodiment, it is characterized in that the carriage 101 which has arrived at the standby position is supported by a carriage supporting slant face 140 provided on the apparatus main body side. With the exception of this point that the carriage 101 is supported by means of the carriage supporting slant face 140 instead of the aforesaid carriage supporting lever 124, the present embodiment has essentially the same structure as the fifth embodiment shown in FIG. 18 to FIG. 21. Also, the foregoing carriage supporting slant face 140 constitutes a fixed carriage supporting means, and in the present embodiment, this face is formed by utilizing the outer wall portion of the recovery unit 121.

In FIG. 26 and FIG. 27, the carriage supporting slant face 140 is of a shape having the slant face portion 141 inclined in the traveling direction of the carriage 101, and a vertex 142 which supports the carriage 101 in the standby position. When a recording operation is completed, the carriage 101 travels in the direction indicated by an arrow Q in order to enter the standby state. As the carriage 101 approaches the standby position, the right lower end of the carriage 101 (in FIG. 26) abuts upon the slant face portion 141 of the carriage 101 supporting slant face 140. Further, as the carriage travels in the direction indicated by the arrow Q, the carriage 101 is pressed upward along the slant portion 141 while being shifted toward the aforesaid vertex 142. Then, the carriage is suspended at the standby position in a state of being supported by the aforesaid vertex 142 in a position indicated by the solid line in FIG. 27.

After the carriage 101 is suspended at the standby position, the fixing pin 115 is pressed upward by the rotation of the fixing pin cam 122. The fixing pin 115 fits in the carriage positioning hole 116 (FIG. 20) of the carriage 101, thus enabling the carriage 101 to be positioned and fixed in the standby position. In this state where the carriage 101 is thus positioned and fixed, the vertex 142 of the carriage supporting slant face 140 abuts upon the bottom end of the carriage 101 or in the position extremely close to it. In other words, in the standby state, the carriage 101 is fixed and supported by the fixing pin 115 thus raised, and the vertex 142 of the carriage supporting slant face 140. Therefore, even when an external force acts on the carriage 101 in the perpendicular direction (direction indicated by the arrow F in FIG. 20), the carriage is supported by these two points. As a result, as in the foregoing fifth embodiment, it is possible to reliably prevent the carriage 101 from being bent or deformed when the attachment or detachment of the recording heads 104 and ink tanks 105 or the gap adjustment for the recording heads 104 are executed on the carriage 101.

When the recording operation is resumed or the like, which necessitates the standby state to be released, the fixing pin 115 descends to the retracted position by the rotation of the fixing pin cam 122, and then, the carriage 101 travels in the opposite direction also indicated by the arrow Q. In this case, the carriage 101 is slidably lowered on the slant face portion 141 of the carriage supporting slant face 140, thus entering the required recording operation.

Figure 28:
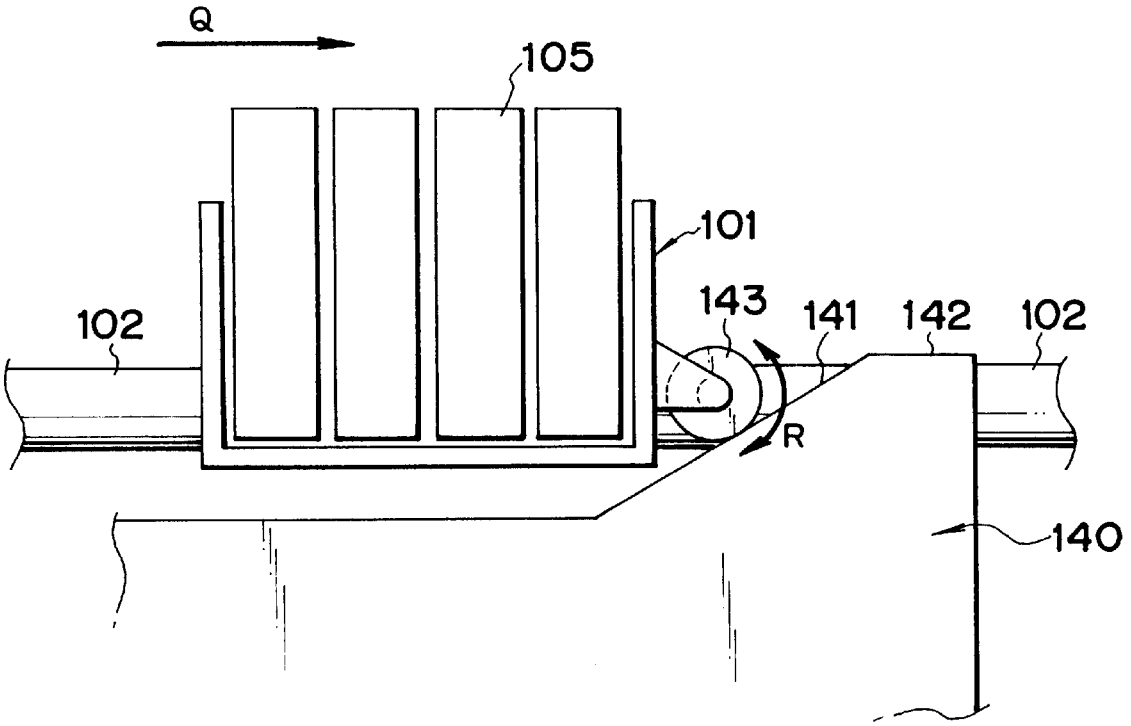
FIG. 28 is a schematic front view showing the state where the carriage having a roller enters its standby position in the recording apparatus shown in FIG. 26.

In order to reduce resistance (load) acting on the carriage 101 when the carriage 101 is shifted along the aforesaid slant face portion 141 in the present embodiment, it may be possible to arrange a structure that a load reducing means such as a rotative roller is provided in the part where the carriage 101 abuts upon the slant face portion 141. FIG. 28 is a schematically partial front view showing an arrangement of the provision of a rotative roller 143 for the carriage 101 in the structure shown in FIG. 26, and FIG. 27. In FIG. 28, the rotational direction of the roller 143 is represented by an arrow R, but if only the roller 143 can rotate by the frictional force between the roller and the slant face portion 141, the rotational direction of the roller 143 is not necessarily limited to the one indicated by the arrow R.

In the present embodiment, while a case where the carriage supporting slant face 140 is provided for the recovery unit 121 is exemplified and described, it may be possible to provide the slant face on some other member or to form it as a dedicated member if only the carriage supporting slant face 140 is a member which is arranged in the carriage standby position of the apparatus main body or in the vicinity thereof. According to the present embodiment, it is possible to obtain the same effects as those obtainable by each of the foregoing embodiments. In addition, the carriage supporting means 140 is constituted by a member which is fixedly provided on the apparatus main body side. Hence, there is no need for any complicated mechanism, and it is possible to obtain an effect that the carriage 101 can be supported only by utilizing the movement of the carriage 101 in the scanning direction.

Here, in each of the above-mentioned embodiments, the description has been made of a case where the recording heads 104 and ink tanks 105 are detachably (exchangeable) mounted on the carriage 101, but irrespective of the mode of the components mounted on the carriage 101, the present invention is equally applicable to the structure in which a head cartridge housing the recording heads and ink tanks, which are integrally formed, is detachably mounted on the carriage 101; to the structure in which only the recording heads are detachably mounted on the carriage 101 while ink is being supplied through tubes or the like; or to some other arrangements, and it is possible to obtain the same functional effects.

Also, In the foregoing embodiments, a case of the recording apparatus which is an ink jet recording apparatus is exemplified and described, but the present invention is equally applicable to a wire dot type, thermal sensitive type, thermal transfer type, laser beam type, or others if only the recording apparatus is the one having the mode that the recording heads and others are detachably mounted on the carriage, and it is possible to obtain the same effects.

Also, in the foregoing embodiments, a color ink jet recording apparatus using plural (four) recording means (recording heads or head cartridges) for recording in different colors is exemplified and described, but irrespective of the number of recording means and the colors in which the recording is executed, the present invention is widely applicable to a recording apparatus sing one recording means; to a recording apparatus for radation recording using a plurality of recording means to record in one and the same color but in different densities; or to the like, and it is possible to obtain the same effects.

In this respect, an ink jet recording apparatus, which is one of the recording apparatuses to which the present invention is applicable, uses recording means (recording heads) having electromechanical transducers such as piezoelectric elements, but the present invention is particularly effective in applying it to an ink jet recording apparatus adopting a method of discharging ink by utilizing thermal energy because with such a method it is possible to attain highly densified recording in a high precision.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system. Particularly, however, it is suitable for the on-demand type because the principle is such that at least one driving signal, which provides a rapid temperature rise beyond a departure from nucleation boiling point in response to recording information, is applied to an electrothermal transducer disposed on a liquid (ink) retaining sheet or liquid passage whereby to cause the electrothermal transducer to generate thermal energy to produce film boiling on the thermoactive portion of the recording means (recording head); thus effectively leading to the resultant formation of a bubble in the recording liquid (ink) one to one for each of the driving signals.

By the development and contraction of the bubble, the liquid (ink) is discharged through a discharging port to produce at least one droplet. The driving signal is preferably in the form of pulses because the development and contraction of the bubble can be effected instantaneously, and then, the liquid (ink) is discharged with an excellent response. The driving signal in the form of pulses is preferably such as disclosed in the specifications of U.S. Pat. Nos. 4,463,359 and 4,345,262. In this respect, the temperature increasing rate of the thermoactive surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid passages, and the electrothermal transducers as disclosed in the above mentioned patents (linear type liquid passage or right angled liquid passage). Besides, the structure such as disclosed in the specifications of U.S. Pat. Nos. 4,558,333 and 4,459,600, in which the thermoactive portions are arranged in a curved area, is also included in the present invention. In addition, the present invention is applicable to the structure disclosed in Japanese Patent Laid-Open Application No. 59-123670 wherein a common slit is used as the discharging ports for plural electrothermal transducers, and also to the structure disclosed in Japanese Patent Laid-Open Application No. 59-138461 wherein an opening for absorbing pressure waves of the thermal energy is formed corresponding to the discharging ports. In other words, according to the present invention, the recording can be executed reliably and efficiently irrespective of the mode of the recording head.

Moreover, the present invention is effectively applicable to a serial type recording head exemplified above; to the recording head which is fixed on the main assembly or a replaceable chip type recording head which is connected electrically with the main apparatus and for which the ink is supplied when it is mounted in the main assembly; or to a cartridge type recording head having an ink container integrally provided for the head itself.

Also, as constituents of a recording head according to the present invention, it is preferable to additionally provide recording head recovery means and preliminarily auxiliary means because these means will contribute to making the effectiveness of the present invention more stable. To name them specifically, such constituents are capping means for the recording head, cleaning means, compression or suction means, preliminary heating means such as electrothermal transducers or heating elements other than such transducers or the combination of those types of elements, and means for effecting a preliminary discharge mode besides the regular discharge for recording.

Further, as the recording mode of the apparatus, the present invention is extremely effective in applying it to an apparatus having at least one of a multi-color mode with ink of different colors, a fullcolor mode using the mixture of the colors, or a mode using the kinds of ink which are of the same color but in different densities, irrespective of whether the recording head is integrally structured or it is structured by a combination of plural recording heads.

Moreover, in the embodiments according to the present invention set forth above, the ink has been described as liquid, but it may be an ink material which is solidified below the room temperature but liquefied at the room temperature. Since the ink is controlled within the temperature not lower than 30° C. and not higher than 70° C. to stabilize its viscosity for the provision of the stable ejection in general, the ink may be such that it can be liquefied when the applicable recording signals are given. In addition, while positively preventing the temperature rise due to the thermal energy by using such energy as the energy to be consumed for changing states of ink from solid to liquid, or using the ink which will be solidified when left intact for preventing the ink from being evaporated, it may be possible to apply to the present invention the use of an ink having a nature of being liquefied only by the application of thermal energy such as an ink capable of being ejected as ink liquid by enabling itself to be liquefied anyway when the thermal energy is given in accordance with recording signals, such as an ink which will have already begun solidifying itself by the time it reaches a recording medium.

For an ink such as this, it may be possible to retain the ink as a liquid or solid material in through holes or recesses formed in a porous sheet as disclosed in Japanese Patent Laid-Open Application No. 54-56847 or Japanese Patent Laid-Open Application No. 60-71260 in order to execute a mode with which to enable the ink to face the electrothermal transducers in such a state. In the present invention, the most effective method for the respective kinds of ink mentioned above is the one which is capable of implementing the film boiling method as described above.

Furthermore, as the mode of a recording apparatus according to the present invention, there are a copying apparatus combined with a reader or the like, and an apparatus executing a mode as a facsimile apparatus having the transmission and reception functions in addition to those which are used as an image output terminal of information processing equipment such as a computer.

Now, by the several embodiments described above or the combinations thereof, the following effects are obtainable:

In a case of a recording apparatus using a DC motor as a carriage driving source, it is impossible to position the carriage exactly because unlike a pulse motor, a DC motor cannot be controlled by the application of pulses. According to the present invention, however, it is possible to position the carriage exactly by the formation of a simple structure which enables fixing means to engage with the carriage even in a recording apparatus using a DC motor as the driving source. In a recording apparatus which uses a pulse motor, it is also possible to operate the carriage positioning more accurately. Further, it is possible to prevent the carriage from being damaged while the recording apparatus is being transported, delivered, or the like before its use.

When a recovery operation and protective capping are executed for the recording heads, the carriage is fixed in a given fixing position with respect to its scanning direction and rotational direction. Thus, there is no looseness created, thus making it possible to execute the recovery operation reliably because the airtightness of the suction cap which executes the recovery operation is extremely fine. Any displacement of the suction cap does not occur, either. The same is applicable to the protective capping required for the recording apparatus when it is not in use.

In a case of a recording apparatus having a plurality of recording heads such as a color recording apparatus, the recovery operations of the recording heads can be executed with one suction pump and suction cap for plural times continuously and reliably.

Also, as another effect, it is possible to provide a recording apparatus capable of preventing the carriage from being bent when the attachment and detachment of the ink tanks and recording heads, the gap adjustment for the recording heads, and the like are executed on the carriage, thus enabling the carriage to be operated and positioned exactly.

Furthermore, by arranging supporting means to be correlatively movable with respect to the apparatus main body, it is possible to make the supporting means retractable at any time other than the standby time for the carriage, thus obtaining an effect that the carriage can be supported while in its standby position without any extra loads which will otherwise be exerted on the traveling carriage.

Moreover, by arranging supporting means to be fixed on the apparatus main body, it is possible to obtain an effect that the carriage can be supported in its standby position just by utilizing the movement of the carriage in its scanning direction without an additional provision of any complicated mechanism on the apparatus main body.

What is claimed is:

1. A recording apparatus having a carriage for moving a recording head along a recording medium, said apparatus comprising:

an engaging member for engaging and supporting the carriage when the carriage is positioned at a predetermined position, said engaging member limiting the carriage to the predetermined position upon engagement thereto; and a carriage supporting member movable between a first position for contacting and supporting the carriage when the carriage is positioned at the predetermined position and a second position retracted and spaced apart from the carriage, wherein said engaging member and said carriage supporting member support the carriage in a same direction.

2. A recording apparatus according to claim 1, further comprising a main body in which said carriage supporting member is housed, wherein the first position and the second position of said carriage supporting member are relative to said main body.

3. A recording apparatus according to claim 1, further comprising a main body, wherein said carriage supporting member is fixed to said main body.

4. A recording apparatus according to claim 3, wherein said carriage supporting member supports the carriage through a roller.

5. A recording apparatus according to claim 1, wherein said carriage supporting member supports the carriage at plural locations.

6. A recording apparatus according to claim 1, wherein the recording head comprises ink jet recording means for recording by discharging ink.

7. A recording apparatus according to claim 6, wherein said ink jet recording means comprises electrothermal transducers which generate thermal energy for heating and discharging the ink.

8. A recording apparatus according to claim 7, wherein said recording means discharges the ink by film boiling which is created in the ink by the thermal energy generated by said electrothermal transducers.

9. A recording apparatus having a carriage for moving a recording head along a recording medium, said apparatus comprising:

an engaging member provided at a predetermined position along a moving path in which the carriage moves, said engaging member being movable between an engaging position for engaging and supporting the carriage and a remote position spaced apart from the moving path, said engaging member limiting the carriage to the predetermined position upon engagement thereto; and a carriage supporting member disposed adjacent said engaging member, said carriage supporting member being movable between a first position for contacting and supporting the carriage when the carriage is positioned at the predetermined position and a second position retracted and spaced apart from the carriage, said engaging member and said carriage supporting member supporting the carriage in a same direction.

10. A recording apparatus according to claim 9, wherein said carriage supporting member supports the carriage at plural locations.

11. A recording apparatus according to claim 9, wherein the recording head comprises ink jet recording means for recording by discharging ink.

12. A recording apparatus according to claim 9, wherein said engaging member comprises a lever rotatable about an axis, and a pin is disposed at one end of said lever to engage with a complementary recess in the carriage.

13. A recording apparatus according to claim 9, wherein said carriage supporting member comprises at least one lever rotatable about an axis, and a support surface is provided at one end of said lever to contact a surface of the carriage.

14. A recording apparatus according to claim 9, wherein said engaging member and said carriage supporting member are positioned relative to the carriage such that the carriage is substantially balanced by forces applied by said engaging member and said carriage supporting member.

15. A recording apparatus comprising:

a carriage for moving a recording head in a moving path along a recording medium, an engagement receiving portion being provided at a lower portion of said carriage, said carriage being movable such that the recording head is movable in directions toward and away from the recording medium;

an engaging member provided at a predetermined position along the moving path, said engaging member being movable between an engaging position for engaging and supporting said engagement receiving portion of said carriage and a remote position spaced apart from the moving path, said engaging member limiting said carriage to the predetermined position upon engagement thereto by pushing said carriage at said engagement receiving portion such that the recording head is moved in the direction away from the recording medium; and a carriage supporting member disposed adjacent said engaging member, said supporting member being movable between a first position for contacting and supporting the lower portion of said carriage and a second position retracted and spaced apart from said carriage, said carriage supporting member for contacting, when in the first position, the lower portion of said carriage when positioned such that the recording head is pushed in the direction away from the recording medium by said engaging member, said engaging member and said carriage supporting member supporting the carriage in a same direction.

16. A recording apparatus according to claim 15, wherein said carriage supporting member supports the carriage at plural locations.

17. A recording apparatus according to claim 15, wherein the recording head comprises ink jet recording means for recording by discharging ink.

18. A recording apparatus according to claim 15, wherein said engaging member comprises a lever rotatable about an axis, and a pin is disposed at one end of said lever to engage with a complementary recess in the carriage comprising said engagement receiving portion.

19. A recording apparatus according to claim 15, wherein said carriage supporting member comprises at least one lever rotatable about an axis, and a support surface is provided at one end of said lever to contact a surface of the carriage.

20. A recording apparatus according to claim 15, wherein said engaging member and said carriage supporting member are positioned relative to the carriage such that the carriage is substantially balanced by forces applied by said engaging member and said carriage supporting member.

21. An ink jet recording apparatus comprising:

a carriage for moving, in a moving path along a recording medium, a recording head for discharging ink through a discharging port, an engagement receiving portion provided at a lower portion of said carriage;

a guide shaft member provided along the moving path of said carriage to guide said carriage, said guide member supporting said carriage rotatably such that the discharging port of the recording head can move in directions toward and away from the recording medium;

a discharge recovery member provided in the moving path of said carriage, out of an area where the recording head records on the recording medium;

an engaging member movable between an engaging position for engaging and supporting said engagement receiving portion of said carriage and a release position for releasing engagement between said engagement receiving portion and said engaging member when said carriage is positioned at a position where said discharge recovery member is capable of recovering the recording head, said engaging member limiting said carriage by pushing said carriage at said engagement receiving portion to move said carriage such that the discharging port is moved in the direction away from the recording medium; and a carriage supporting member disposed adjacent said engaging member, said carriage supporting member being movable between a first position for contacting and supporting said lower portion of said carriage and a second position retracted and spaced apart from said carriage, said carriage supporting member for contacting in the first position said lower portion of said carriage when positioned such that the discharging port is pushed in the direction away from the recording medium by said engaging member, said engaging member and said carriage supporting member supporting the carriage in a same direction.

22. An ink jet recording apparatus according to claim 21, wherein said carriage further mounts an ink tank for supplying ink to the recording head, and the position where said discharge recovery member is capable of recovering the recording head is a position where the ink tank is mountable on said carriage.

23. A recording apparatus according to claim 21, wherein said carriage supporting member supports the carriage at plural locations.

24. A recording apparatus according to claim 21, wherein the recording head comprises ink jet recording means for recording by discharging the ink.

25. A recording apparatus according to claim 21, wherein said engaging member comprises a lever rotatable about an axis, and a pin is disposed at one end of said lever to engage with a complementary recess in the carriage comprising said engagement receiving portion.

26. A recording apparatus according to claim 21, wherein said carriage supporting member comprises at least one lever rotatable about an axis, and a support surface is provided at one end of said lever to contact a surface of the carriage.

27. A recording apparatus according to claim 21, wherein said engaging member and said carriage supporting member are positioned relative to the carriage such that the carriage is substantially balanced by forces applied by said engaging member and said carriage supporting member.

28. An ink jet recording apparatus having a carriage for moving an ink jet recording head along a recording medium, said apparatus comprising:

a cap holder located outside of a recording area where the ink jet recording head records the recording medium, said cap holder holding a cap member for covering an ink discharge port of the ink jet recording head; and a support member for supporting the carriage in a direction parting from said cap holder when the carriage is at a position opposed to said cap holder, said support member maintaining more than a predetermined distance between the carriage and said cap holder.

29. An ink jet recording apparatus according to claim 28, wherein the position opposed to said cap holder is a position where an ink tank is removably mounted on the carriage.

30. An ink jet recording apparatus according to claim 28, wherein said support member supports the carriage at plural locations.

31. An ink jet recording apparatus according to claim 28, wherein the ink jet recording head comprises electrothermal transducers which generate thermal energy for heating and discharging the ink.

32. An ink jet recording apparatus according to claim 28, wherein the ink jet recording head discharges the ink by film boiling which is created in the ink by the thermal energy generated by said electrothermal transducers.

33. An ink jet recording apparatus according to claim 28, wherein said support member comprises at least one lever rotatable about an axis, and a support surface is provided at one end of said lever to contact a surface of the carriage.

* * * * *